US011103068B1

(12) United States Patent
Koeppel et al.

(10) Patent No.: US 11,103,068 B1
(45) Date of Patent: Aug. 31, 2021

(54) MODULAR WALL ORGANIZATION SYSTEM AND ACCESSORIES THEREFOR

(71) Applicant: Continental Accessory Corporation, Jericho, NY (US)

(72) Inventors: Ronald Koeppel, Brookville, NY (US); Richard P. Koeppel, Palm Beach, FL (US); John Kraljic, Riverhead, NY (US)

( * ) Notice: Subject to any disclaimer, the term of this patent is extended or adjusted under 35 U.S.C. 154(b) by 0 days.

(21) Appl. No.: 16/859,178

(22) Filed: Apr. 27, 2020

(51) Int. Cl.

| | |
|---|---|
| ***A47B 97/00*** | (2006.01) |
| ***A47F 5/08*** | (2006.01) |
| ***G09F 7/18*** | (2006.01) |
| ***B43L 1/00*** | (2006.01) |
| *B43L 1/04* | (2006.01) |

(52) U.S. Cl.
CPC ..... *A47B 97/001* (2013.01); *A47F 5/0823* (2013.01); *A47F 5/0846* (2013.01); *B43L 1/00* (2013.01); *G09F 7/18* (2013.01); *B43L 1/04* (2013.01); *G09F 2007/1843* (2013.01); *G09F 2007/1847* (2013.01); *G09F 2007/1891* (2013.01)

(58) Field of Classification Search
CPC ... A47B 97/001; A47B 47/0025; A47B 47/03; A47B 47/05; A47B 496/04; A47F 5/0846; A47F 5/0823; A47F 87/0223; A47F 87/0246; A47F 87/007; A47F 87/02; A47F 87/0276; G09F 7/18; G09F 2007/1847; G09F 2007/1843; G09F 2007/1891; G09F 15/0012; G09F 2007/1856; B43L 1/00; B43L 1/04; A47G 1/065; A47G 1/101; A47G 1/102; F16B 5/0016; F16B 5/002; F16B 5/0092; F16B 5/0024; F16B 5/0004; F16B 5/0008; F16B 5/0012; F16B 5/06; F16B 5/0607; F16B 5/0621; Y10T 403/55; Y10T 403/553; Y10T 403/342; Y10T 403/347
See application file for complete search history.

(56) References Cited

U.S. PATENT DOCUMENTS 3,799,466 A * 3/1974 Adams ..... B65H 16/005 242/596.3
3,955,298 A * 5/1976 Kapstad ..... G09F 1/12 40/782

(Continued)

FOREIGN PATENT DOCUMENTS

DE 4035367 A1 * 5/1992 ..... A47G 1/142

*Primary Examiner* — Ko H Chan
(74) *Attorney, Agent, or Firm* — Caesar Rivise, PC

(57) ABSTRACT

A modular wall organization system including one or plural board assemblies. Each of the board assemblies includes a frame and at least one planar panel held by the frame. Some of the frames include hollow frame sections and corner nodes, which connect the frame sections. The frame sections are configured to be used with hangers for mounting various types of accessories on the board assembly or for connecting plural board assembles together. Some of the accessories are trays, baskets, rolls of writing material, and panel insert assemblies. The panel insert assemblies include various panels, such as cork-boards, dry-erase boards, chalk-boards, fabric-boards, slat-boards, letter-to boards and other types of boards or panels. Some of the frames are in the form of solid frame sections.

19 Claims, 20 Drawing Sheets

(56) References Cited

U.S. PATENT DOCUMENTS 4,047,615 A * 9/1977 Browne ..... A47F 5/0087 211/88.01
4,862,612 A * 9/1989 Sugihara ..... A47G 1/101 40/782
5,205,102 A * 4/1993 Plummer ..... E06B 3/9687 52/656.9
5,658,635 A * 8/1997 Davis ..... A47B 97/04 40/793
5,743,414 A * 4/1998 Baudino ..... B43K 23/001 211/69.1
5,806,256 A * 9/1998 Byrne ..... E06B 3/08 52/204.5
5,989,676 A * 11/1999 Davis ..... A47B 97/04 248/205.1
6,377,320 B1 * 4/2002 Ananian ..... G06F 1/1609 312/7.2
6,443,415 B1 * 9/2002 Sundblad ..... G06F 1/1607 248/442.2
6,945,785 B2 * 9/2005 Sohl ..... B43L 1/00 434/408
7,604,481 B2 * 10/2009 Owen ..... A47B 97/001 434/408
7,874,842 B2 * 1/2011 Beno ..... B32B 27/36 434/408
9,162,516 B2 * 10/2015 Kang ..... B43L 1/06
10,687,637 B2 * 6/2020 Duijts ..... A47F 5/0869
2006/0216686 A1 * 9/2006 McComb ..... B43L 1/04 434/408
2008/0199842 A1 * 8/2008 Hardt ..... B43K 23/001 434/417
2010/0043268 A1 * 2/2010 Powell ..... A47G 1/10 40/741
2010/0212462 A1 * 8/2010 Anderson ..... A47F 5/0823 81/121.1
2013/0036640 A1 * 2/2013 Miller ..... G09F 7/18 40/603
2013/0157246 A1 * 6/2013 Shapiro ..... B43K 29/00 434/408
2014/0061401 A1 * 3/2014 Bernstein ..... A47F 5/0823 248/125.3
2014/0091051 A1 * 4/2014 Battilana ..... G09F 15/0012 211/119.003
2014/0255902 A1 * 9/2014 Kang ..... B43L 1/00 434/408
2015/0024369 A1 * 1/2015 Brown ..... B43L 1/00 434/416

* cited by examiner

Fig. 8A
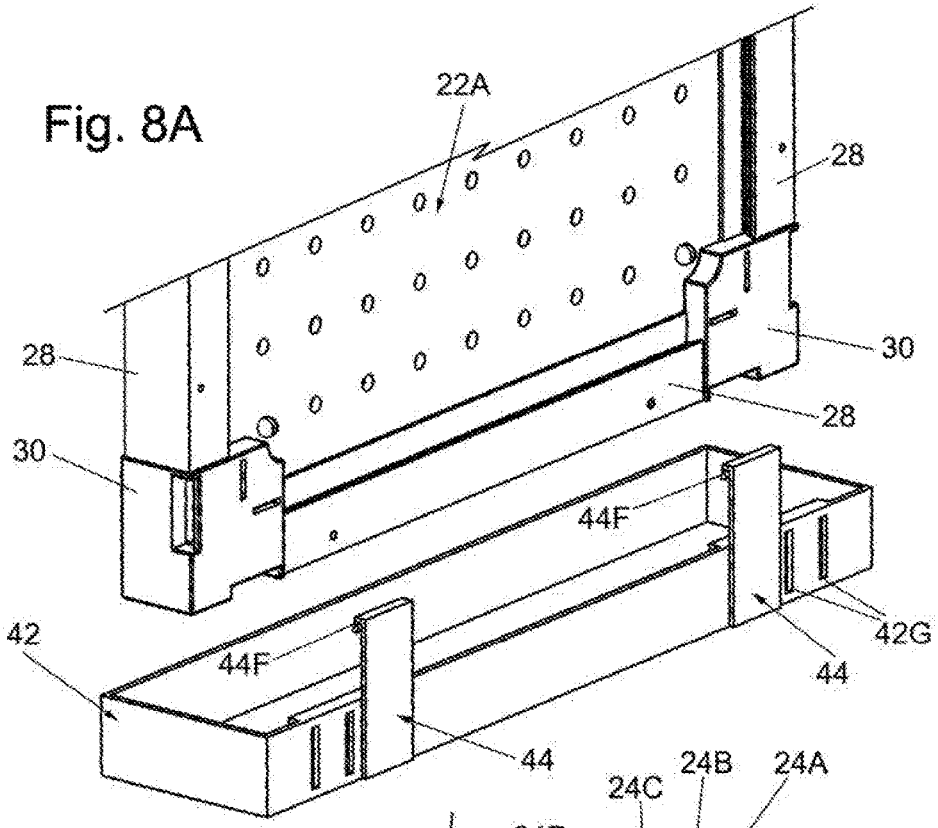
Fig. 8B
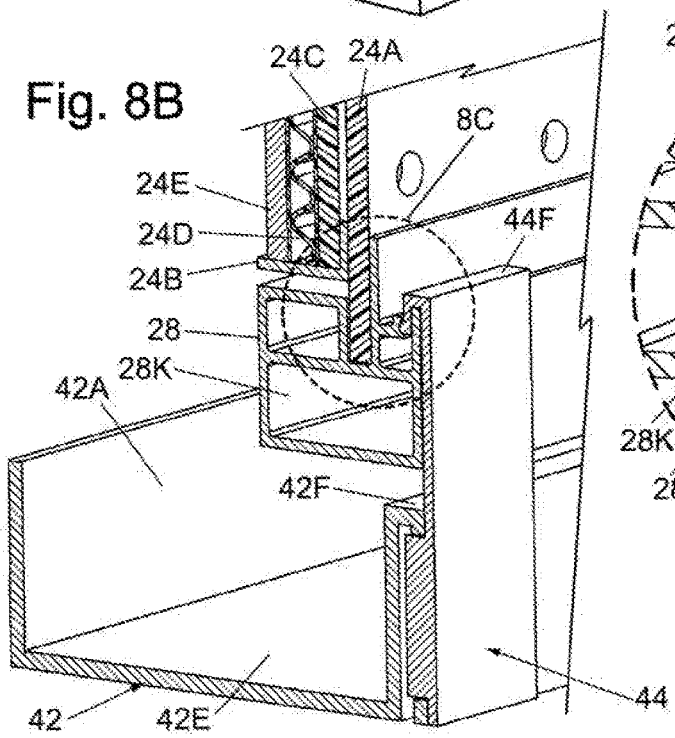
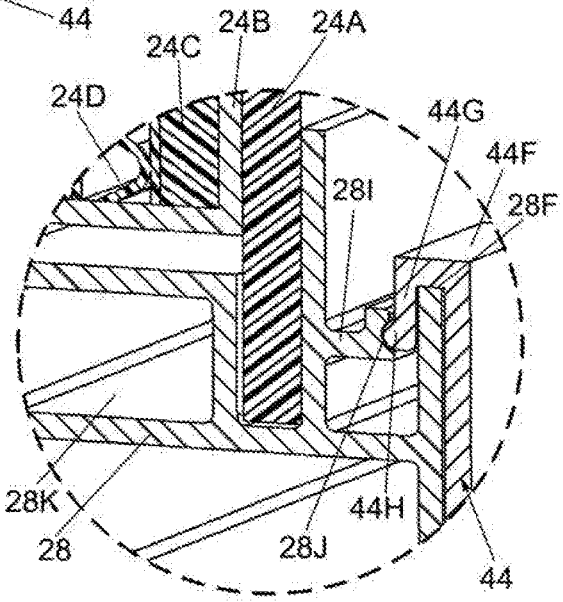
Fig. 8C

Fig. 8D
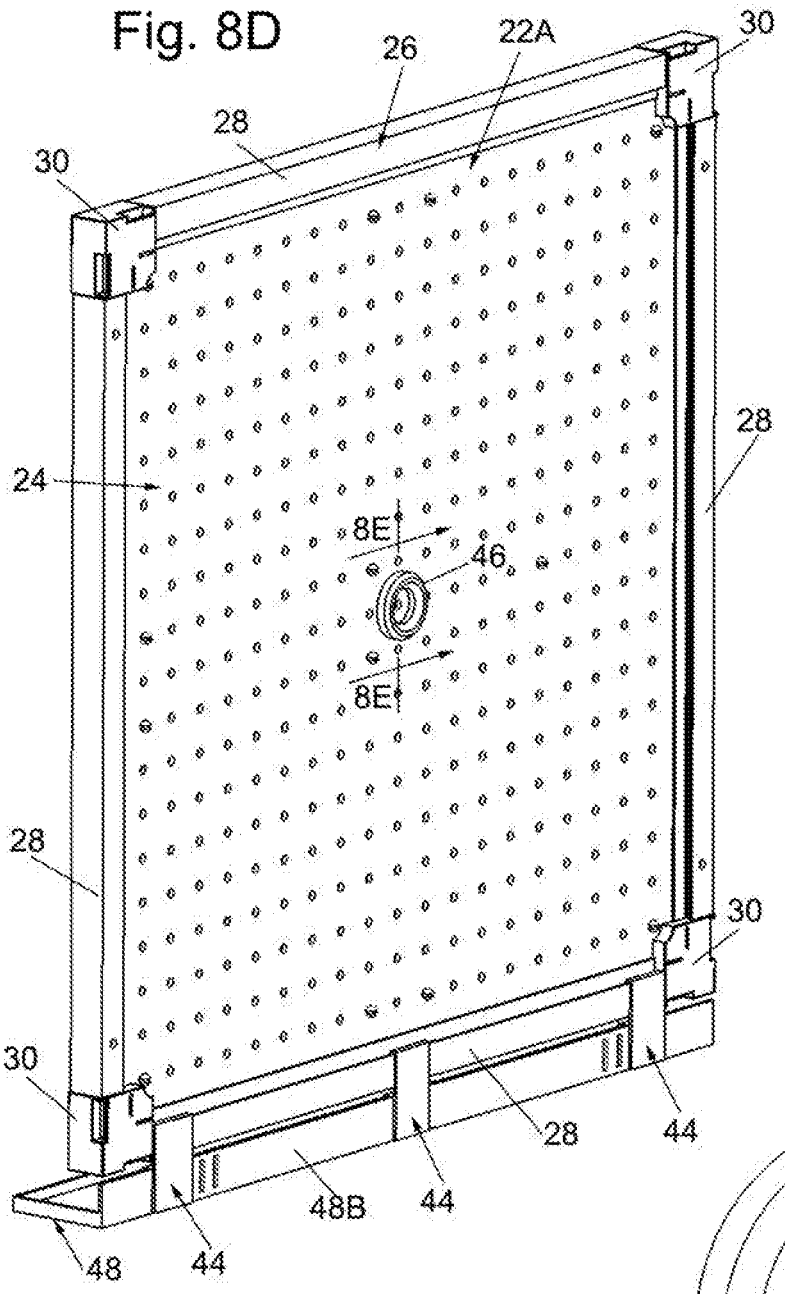
Fig. 8E
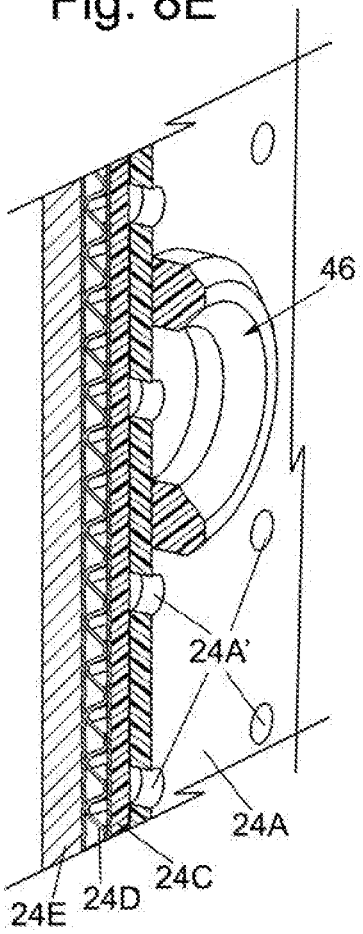
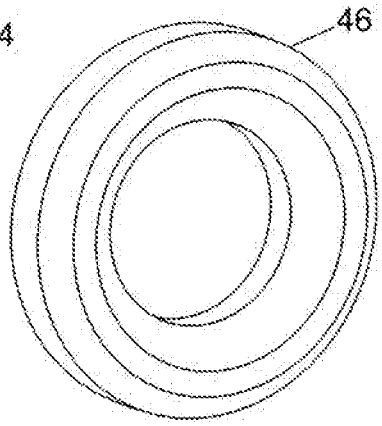
Fig. 8F

Fig. 26
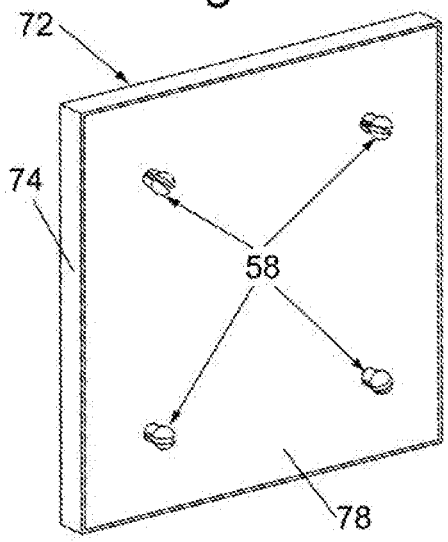
Fig. 27
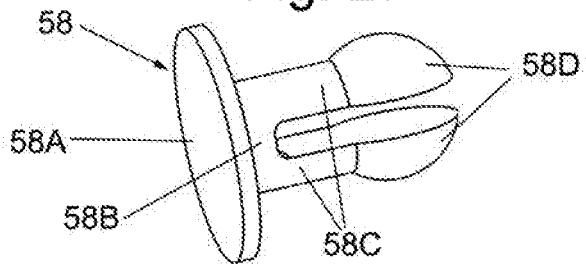
Fig. 28A
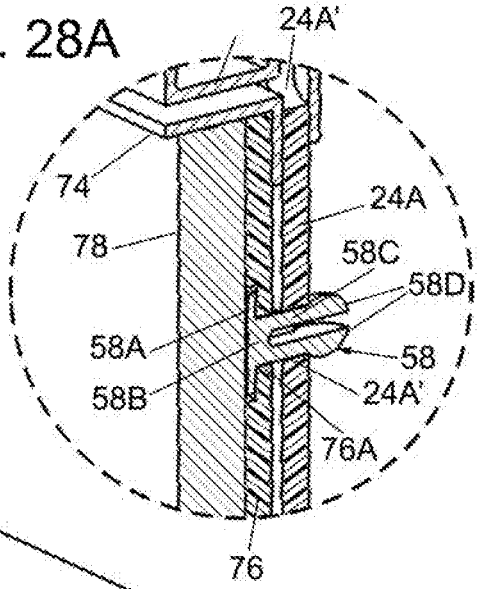
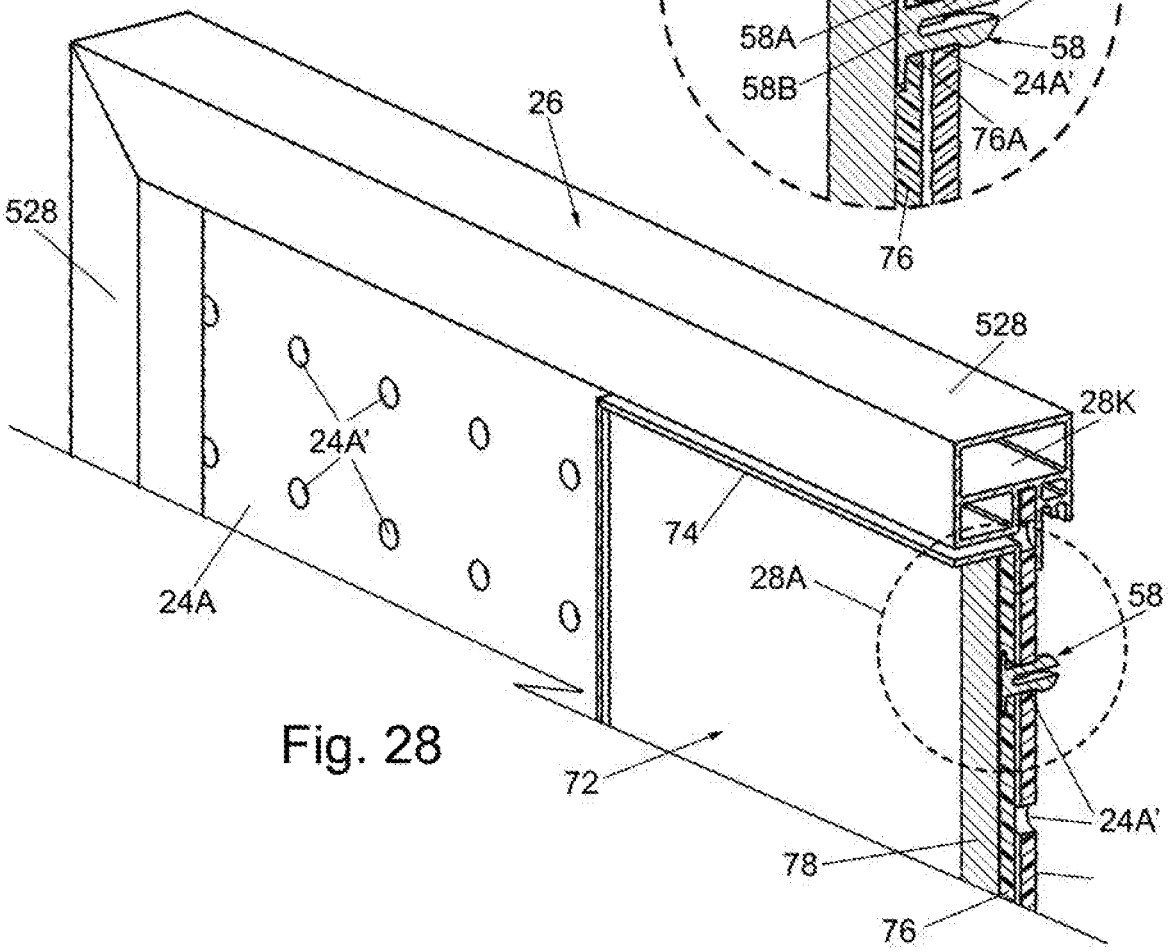
Fig. 28

Fig. 29
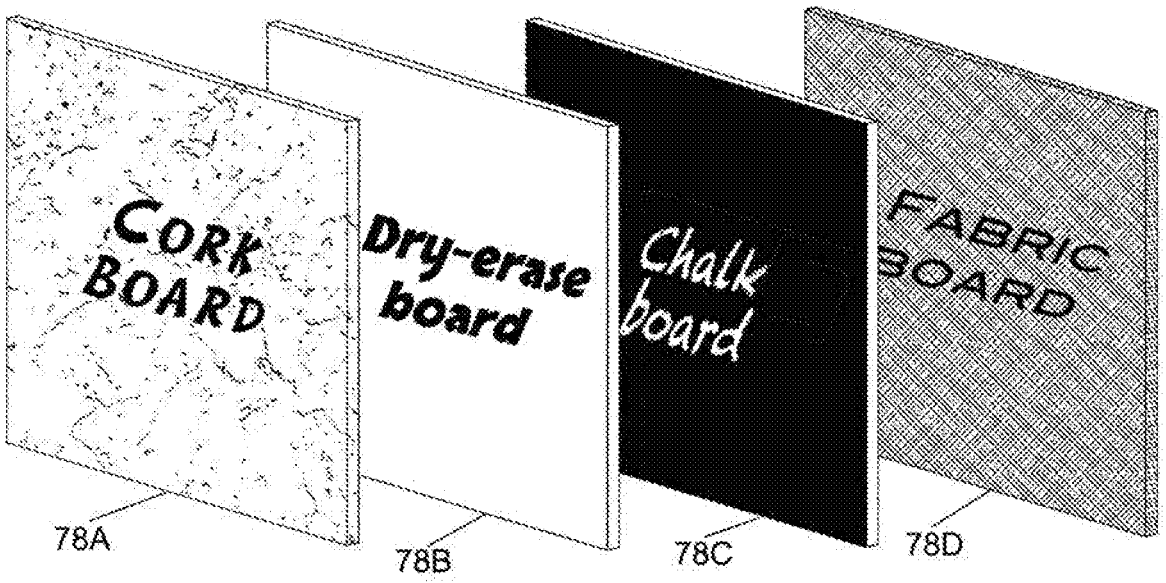
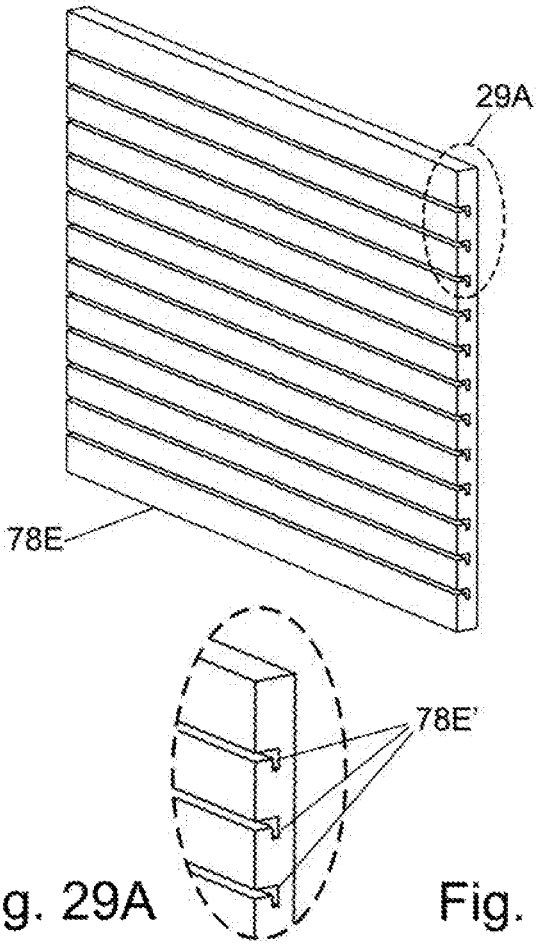
Fig. 29A
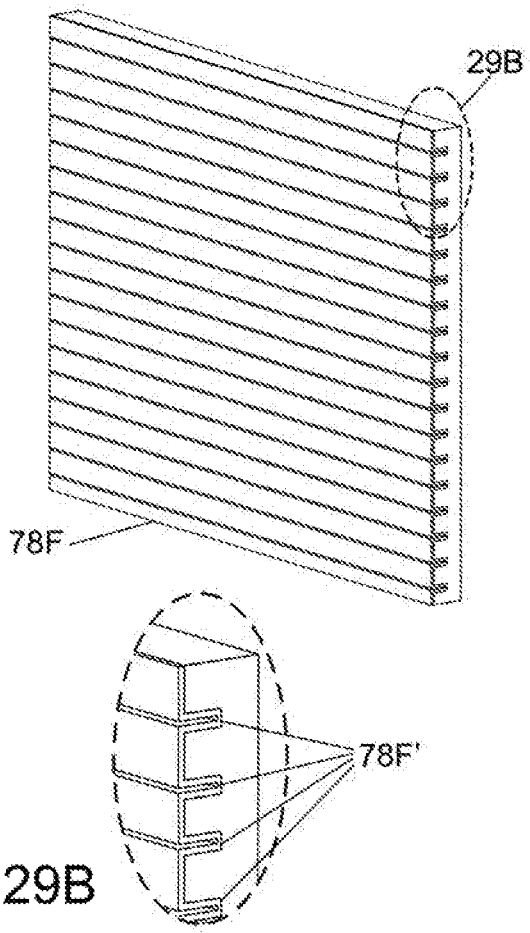
Fig. 29B

Fig. 35
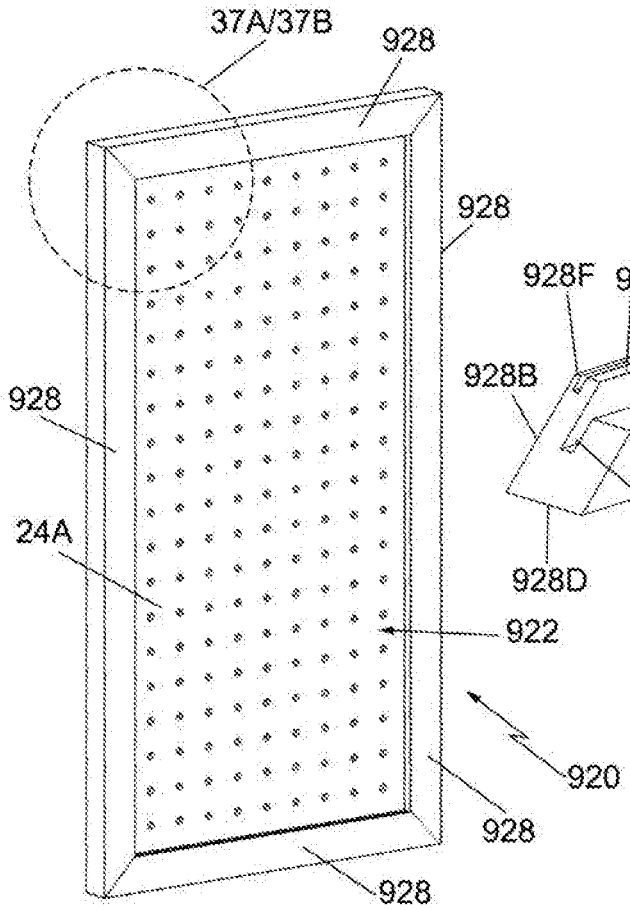
Fig. 36
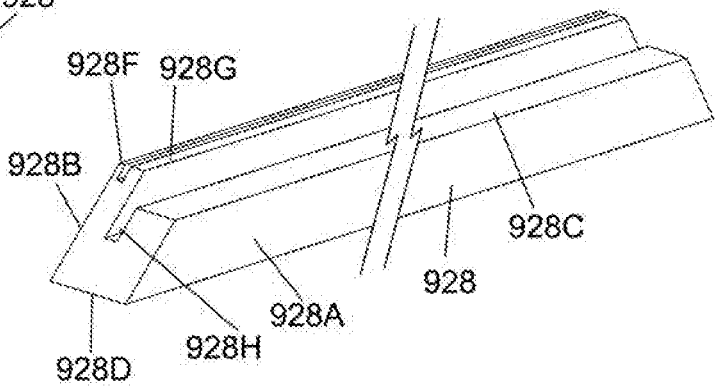
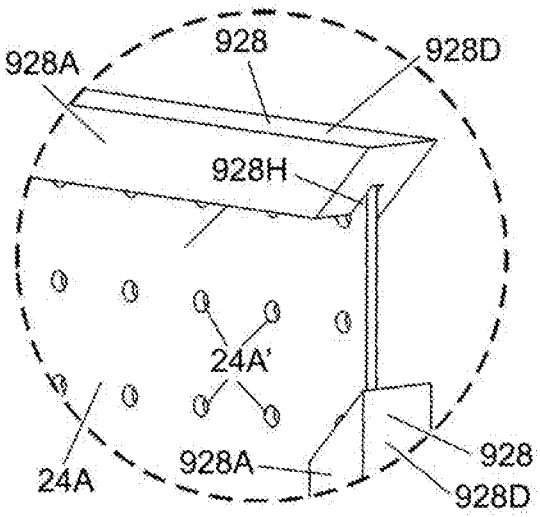
Fig. 37A
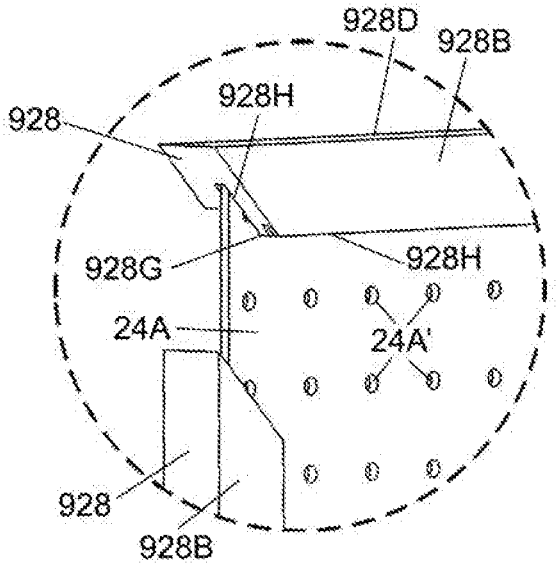
Fig. 37B

MODULAR WALL ORGANIZATION SYSTEM AND ACCESSORIES THEREFOR

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

FIELD OF THE INVENTION

This invention relates generally to organization systems, e.g., bulletin boards, and more particularly to modular wall organization systems for mounting on a wall.

BACKGROUND OF THE INVENTION

Various bulletin boards are commercially available for mounting on a wall of a structure. The term "bulletin boards" is used herein as an example only of the many types of board assemblies that can be used to create a wall organization system of the subject invention. While prior art bulletin boards are generally suitable for their purposes, they aren't modular, nor do they provide a user with the ability to readily connect and disconnect a plurality of such boards together in various configurations and to be able to mount the assembled configuration of plural boards on a wall of a structure or to readily mount accessories thereon. Thus, a need exists for a modular wall organization system, e.g., a modular bulletin board system, which can readily connect plural various sized and/or shaped components, e.g., boards, to each other in various configurations, and which can be readily mounted on a wall and which may serve various functions, e.g., be a cork board, a dry eraser board, a chalk board, a mirror, a picture frame, a peg board, etc.

In our U.S. patent application Ser. No. 16/807,592, filed on Mar. 3, 2020, entitled Modular Wall Organization System, which is assigned to the same assignee as this invention, and whose disclosure is specifically incorporated by reference herein, there is disclosed a system that addresses that need.

The subject invention entails improvements to the modular wall organization systems of our aforementioned patent application and also includes various accessories therefor to provide enhanced modular wall organization systems that are even more useful for a multitude of uses in homes, offices, educational institutions, medical facilities, etc.

All references cited and/or identified herein are specifically incorporated by reference herein.

SUMMARY OF THE INVENTION

One aspect of this invention is a modular wall organization system that is configured to be mounted on a wall of a structure. The modular wall organization system comprises a first board assembly. The first board assembly comprises a first planar panel and a first frame assembly. The first planar panel has plural corners. The first frame assembly comprises plural elongated first frame sections, and plural first corner nodes.

Each of the plural first corner nodes includes a projection. Each of the elongated first frame sections has a front face, a rear face, an inner face, an outer face, and an opposed pair of hollow ends. Each of the hollow ends is configured to receive and snap-fit a respective projection of a respective first corner node for connecting the plural first elongated frame sections to one another to surround and hold the first planar panel. The first frame assembly has a front face, a rear face, an inner face and an outer face formed by the front faces, the rear faces, the inner faces, and the outer faces, respectively, of the elongated first frame sections. At least one of the elongated first frame sections includes a first projecting flange extending flush with or closely adjacent and parallel to the rear face. The first projecting flange is configured to mount a clip or hanger thereon.

In accordance with one preferred aspect of the modular wall organization system of this invention the system additionally comprises a second board assembly. The second board assembly comprises a second planar panel having plural corners and a second frame assembly. The second frame assembly comprises plural elongated second frame sections, and plural second corner nodes. Each of the second plural corner nodes of the second frame assembly includes a projection. Each of the second elongated frame sections of the second frame assembly has a front face, a rear face, an inner face, an outer face, and an opposed pair of hollow ends. Each of the hollow ends is configured to receive and snap-fit a respective projection of a respective second corner node for connecting the plural elongated second frame sections together to surround and hold the second planar panel. At least one of the first corner nodes of the first frame assembly is configured to be releasably connected to at least one of the second corner nodes of the second frame assembly by a releasably securable snap-connector.

In accordance with another preferred aspect of the modular wall organization system of this invention each of the first corner nodes comprises a body that has a back surface, a first side edge, a second side edge, a first channel, and a second channel. The first side edge of the first corner node extends at a predetermined angle to the second side edge of the first corner node. The first channel of the first corner node member extends into the body of the first corner node member from the first side edge of the first corner node member. The second channel extends into the body of the first corner node member from the second side edge of the first corner node member. The second corner node comprises a body having a back surface, a first side edge, a second side edge, a first channel, and a second channel. The first side edge of the second corner node extends at a predetermined angle to the second side edge of the second corner node. The first channel of the second corner node extends into the body of the second corner node from the first side edge of the second corner node. The second channel of the second corner node extends into the body of the second corner node from the second side edge of the second corner node. The releasably securable snap-connector has a first extending portion and a second extending portion. The first extending portion is configured to snap-fit into one of the first and second channels of the first corner node. The second extending portion is configured to snap-fit into one of the first and second channels of the second corner node to secure the first corner node to the second corner node.

In accordance with another preferred aspect of the modular wall organization system of this invention the system additionally comprises an accessory and at least one clip. The accessory is configured for mounting on the first board assembly by the at least one clip. The accessory comprises a wall including a least one slot therein. The clip has a portion configured to snap-fit within the at least one slot to secure the clip to the wall. The clip includes a portion configured for mounting on the first projecting flange of the first elongated frame section of the first frame assembly.

In accordance with another preferred aspect of the modular wall organization system of this invention the accessory is selected from a group consisting of a tray, a basket, a support rod, and a cubby-hole unit.

In accordance with another preferred aspect of the modular wall organization system of this invention one of the first elongated frame members of the first frame assembly is an upper frame member and wherein the modular wall organization system additionally comprises an accessory and at least one hanger. The accessory is configured for mounting on the first board assembly by the at least one hanger engaging the upper frame member.

In accordance with another preferred aspect of the modular wall organization system of this invention the accessory comprises a roll of writing material having a central opening and a cylindrical rod extending through the central opening. The at least one hanger includes an upper hook portion configured to extend over and engage the upper frame member, and a lower section including a curved socket configured for supporting an end of the central cylindrical rod.

In accordance with another preferred aspect of the modular wall organization system of this invention one of the first elongated frame members of the first frame assembly is an upper frame member and wherein the modular wall organization system additionally comprises an accessory and at least one hanger having an upper hook portion. The accessory is configured for mounting on the first board assembly by the upper hook portion of the at least one hanger engaging the upper frame member. The accessory comprises an insert panel assembly comprising a planar panel and a frame surrounding the planar panel. The frame includes an upper elongated frame section having a rear face and a downwardly projecting flange extending flush with or closely adjacent and parallel to the rear face. The at least one hanger includes a flanged portion configured to receive the downwardly projecting flange.

In accordance with another preferred aspect of the modular wall organization system of this invention the planar panel is selected from the group consisting of a cork-board, a dry-erase board, a chalk-board, a fabric-wrapped board, a slat-board, and a letter-board.

In accordance with another preferred aspect of the modular wall organization system of this invention the frame of the insert panel assembly is constructed similarly to the first frame assembly.

In accordance with another preferred aspect of the modular wall organization system of this invention the first planar panel comprises peripheral edge portions and wherein each of the first elongated frame sections of the first frame assembly additionally comprises a gap adjacent the inner face thereof. Each of the gaps is configured to receive a respective peripheral edge portion of the first planar panel.

In accordance with another preferred aspect of the modular wall organization system of this invention the first planar panel is a peg-board having plural holes therein configured for receipt of at least one snap-connector pin to mount an item thereon.

In accordance with another preferred aspect of the modular wall organization system of this invention the item comprises a frame holding a rear panel and a front panel. The rear panel includes at least snap-connector pin projecting outward from the rear panel for releasable securement with one of the plural holes in the peg-board.

In accordance with another preferred aspect of the modular wall organization system of this invention the front panel is a planar panel selected from the group consisting of a cork-board, a dry-erase board, a chalk-board, a fabric-wrapped board, a slat-board, and a letter-board.

In accordance with another preferred aspect of the modular wall organization system of this invention the first planar panel is formed of a ferromagnetic material and the system additionally comprises an accessory. The accessory comprises a planar accessory panel having corners and plural magnetically securable brackets. Each of the magnetically securable brackets comprises a threaded clamping member, a pair of sidewalls merging together at a corner, and a front wall connected to the sidewalls. The front wall has an internally threaded hole extending through it. Each of the sidewalls has an undersurface. At least one of the undersurfaces is magnetic and configured to be magnetically secured to the ferromagnetic material panel. The threaded clamping member has a cap from which an externally threaded shaft projects. The externally threaded shaft extends through the internally threaded hole in the front wall and has an end configured for engaging a surface of the planar accessory panel to releasably secure the planar accessory panel on the planar ferromagnetic panel.

In accordance with another preferred aspect of the modular wall organization system of this invention the planar accessory panel is selected from the group consisting of a cork-board, a dry-erase board, a chalk-board, a fabric-wrapped board, a slat-board, and a letter-board.

In accordance with another preferred aspect of the modular wall organization system of this invention each of the rear face of each of the elongated first frame sections at the hollow end thereof includes a hole, and wherein each of the first corner nodes includes a detent mechanism in the form of a spring finger terminating and a thickened or bulbous end. The bulbous end is configured for receipt in a respective one of the holes to effect the snap-connection between the first corner nodes and the first elongated frame sections.

Another aspect of this invention is a modular wall organization system configured to be mounted on a wall of a structure. That modular wall organization system comprises a first board assembly, which itself comprises a first planar panel and a first frame. The first planar panel has plural corners and peripheral edge portions. The first frame comprises plural elongated first frame sections. Each of the elongated first frame sections is a solid member having a front face, a rear face, an inner face, an outer face, a gap in the inner face, and an opposed pair of mitered ends. The mitered ends engage and are secured to one another whereupon the first frame encircles and holds the first planar panel with respective one of the peripheral edge portions of the first planar panel located in the gap of a respective first frame section. The first frame has a front face, a rear face, an inner face and an outer face formed by the front faces, the rear faces, the inner faces, and the outer faces, respectively, of the elongated first frame sections. At least one of the elongated first frame sections includes a first projecting flange extending flush with or closely adjacent and parallel to the rear face. The first projecting flange is configured to mount a clip or hanger thereon In accordance with one preferred aspect of the modular wall organization system it additionally comprises an accessory and at least one clip. The accessory is configured for mounting on the first board assembly by the at least one clip. The accessory comprises a wall including a least one slot therein. The clip has a portion configured to snap-fit within the at least one slot to secure the clip to the wall. The clip includes a portion configured for mounting on the first projecting flange of the first elongated frame section of the first frame.

In accordance with another preferred aspect of the modular wall organization system the accessory is selected from a group consisting of a tray, a basket, a support rod, and a cubby-hole unit.

In accordance with another preferred aspect of the modular wall organization system the first planar panel is a peg-board having plural holes therein configured for receipt of at least one snap-connector pin to mount an item thereon.

In accordance with another preferred aspect of that modular wall organization system the item comprises a frame holding a rear panel and a front panel. The rear panel includes at least snap-connector pin projecting outward from the rear panel for releasable securement with one of the plural holes in the peg-board.

In accordance with another preferred aspect of that modular wall organization system the front panel is a planar panel selected from the group consisting of a cork-board, a dry-erase board, a chalk-board, a fabric-wrapped board, a slat-board, and a letter-board.

DESCRIPTION OF THE DRAWING

FIG. 8A is an enlarged isometric view showing the tray with the clips attached thereto about to be mounted on a board assembly like that of FIGS. 1A and 1B;

FIG. 8B is an enlarged isometric view, partially broken away along a vertical axis showing the tray with the clips attached thereto after is has been mounted on the board assembly of the modular wall organization system shown in FIG. 8A;

FIG. 8C is an greatly enlarged view of the portion of the system shown within the broken line circle designated by the reference number 8C of FIG. 8B;

FIG. 8D is a rear isometric view of another exemplary embodiment of a modular wall organization system including a board assembly constructed in accordance with this invention and mounting an alternative exemplary accessory tray and mounting clips constructed in accordance with this invention and with the board assembly including a accessory wall spacer disk constructed in accordance with this invention;

FIG. 8E is an enlarged vertical isometric sectional view taken along line 8E-8E of FIG. 8D;

FIG. 8F is an enlarged isometric view of the accessory wall spacer disk shown in FIG. 8D;

FIG. 26 is an enlarged isometric view showing the rear of the assembled insert panel assembly shown in FIGS. 24 and 25;

FIG. 27 is a greatly enlarged isometric view of one of the components, e.g., a snap-connector pin, making up the insert panel assembly shown in FIGS. 25 and 26;

FIG. 28 is an enlarged isometric sectional view taken along line 28-28 of FIG. 24;

FIG. 28A is a more greatly enlarged front isometric view of the portion of the board assembly shown within the broken circle designated by the reference number 28A of FIG. 28;

FIG. 29 is an exploded isometric view of six exemplary panels that can be used to form the front surface panel of the insert panel assembly shown in FIGS. 25 and 26;

FIG. 29A is an enlarged front isometric view of the portion of the panel shown within the broken circle designated by the reference number 29A in FIG. 29;

FIG. 29B is an enlarged front isometric view of the portion of the panel shown within the broken circle designated by the reference number 29B in FIG. 29;

FIG. 35 is an isometric view of another board assembly of a wall organization system constructed in accordance with this invention making use of a frame composed of four mitered solid frame sections secured to each other by an adhesive or some other conventional connecting means;

FIG. 36 is an enlarged isometric view, partially broken away, of one of the mitered solid frame sections making up the frame of the board assembly shown in FIG. 35;

FIG. 37A is an enlarged front isometric view of the portion of the board assembly shown within the broken circle designated by the reference number 37A/37B of FIG. 37; and FIG. 37B is an enlarged rear isometric view of the portion of the board assembly shown within the broken circle designated by the reference number 37A/37B of FIG. 37.

DETAILED DESCRIPTION OF THE PREFERRED EMBODIMENT

Figure 1A:
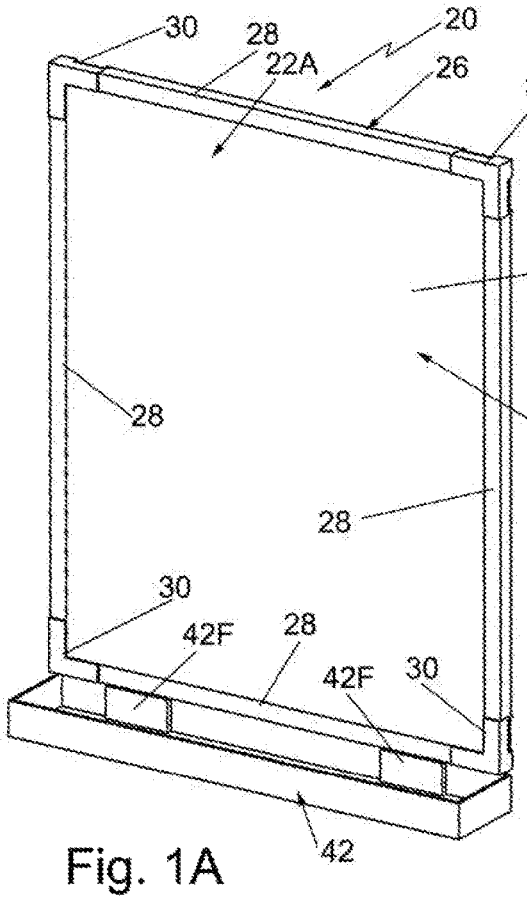
FIG. 1A is a front isometric view of one exemplary embodiment of a modular wall organization system including a first board assembly constructed in accordance with this invention and mounting one exemplary accessory, e.g., a tray and associated mounting clips, also constructed in accordance with this invention.
Figure 1B:
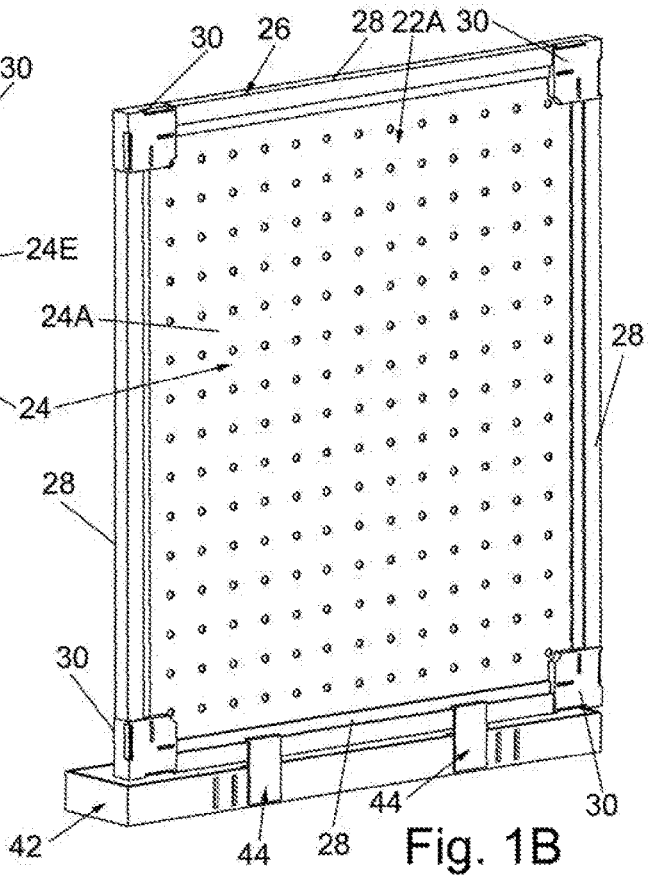
FIG. 1B is a rear isometric view of the embodiment of the modular wall organization system shown in FIG. 1A.

Referring now to the various figures of the drawing wherein like reference characters refer to like parts, there is shown in FIGS. 1A and 1B one exemplary embodiment of the modular wall organization system 20 constructed in accordance with this invention. That exemplary system includes an exemplary accessory, e.g., a tray, mounted thereon. As will be described in detail later, the board assembly 22A includes a frame assembly formed plural elongated frame sections and plural corner nodes which interconnect the plural elongated frame sections. The frame assembly itself surrounds a planar panel assembly which can be in the form of a cork-board, a dry-erase board, a chalk-board, a peg-board, a fabric-covered panel, a slat-board, a letter-board, a metal (e.g., galvanized) panel, an acrylic panel, etc.

It must be point out at this juncture that the modular wall organization systems of this invention can include a single board assembly or plural board assemblies connected together in any particular desired arrangement so that they are arranged vertically and/or horizontally to form any type of modular wall organization system, e.g., a bulletin board system or some other wall organization system, for any desired application or use.

The particular exemplary wall organization system 20 of FIGS. 1A and 1B is in the form of a single modular dry-erase board assembly 22A and constitutes a variation of one of the board assemblies of the modular wall organization system shown in FIGS. 1 and 2 of our aforementioned patent application and which are designated as "Board #1" and "Board #2). However, the board assembly 20A of this invention makes use of slightly different frame assemblies, e.g., corner nodes and elongated frame sections, from the board assemblies of our aforementioned patent application. In addition, some of the modular wall organization systems of this invention, if configured to include two or more board assemblies connected together, make use of a slightly modified snap connector for releasably connecting at least one corner node of one board assembly to an adjacent corner node of another board assembly.

The board assembly 22A basically comprises a panel assembly 24 and a frame assembly 26. The frame assembly comprises plural elongated frame sections 28 (FIGS. 1A, 1B and 2A) and plural corner nodes (also sometimes referred to hereinafter as corner node members) 30 which are interconnected to one another. The panel assembly 24 can be in the form of a single planar panel formed of any suitable material for a particular purpose, e.g., a peg-board panel, or may be a multi-layer structure like shown in the cross sectional view of FIG. 3F. That exemplary panel assembly comprises a planar rear or base panel 24A, preferably in the form of a peg-board made up of any suitable material, e.g., Masonite, particle board, etc. The peg-board includes a plurality of holes 24A' spaced from one another in a typical grid-like array. Each of the holes 24A' is configured to accept a snap-connector pin 58 (FIG. 27) constructed in accordance with this invention and which will be described later.

Figure 3A:
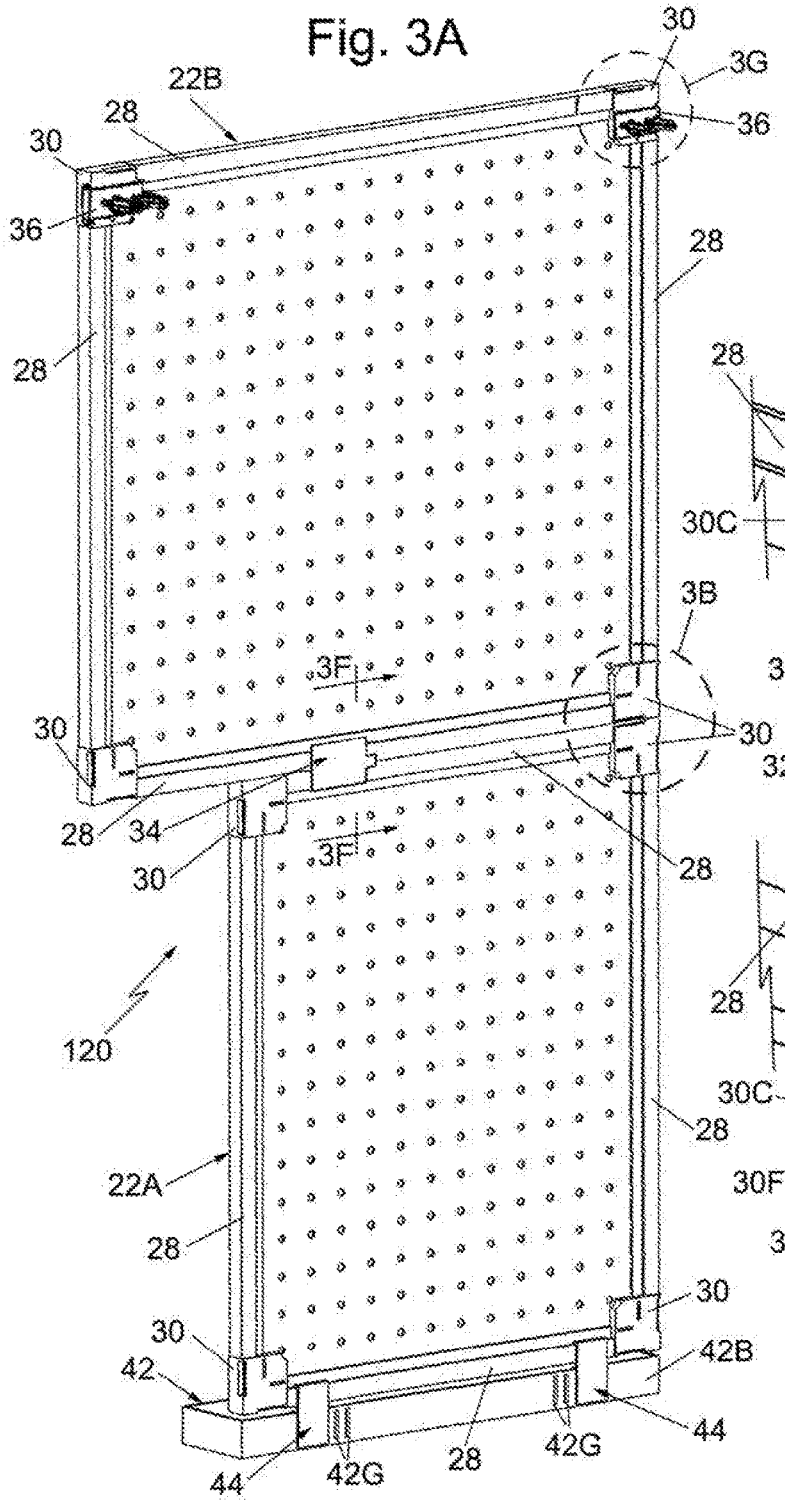
FIG. 3A is an isometric view of an alternative exemplary embodiment of a modular wall organization system including a first board assembly and a second board assembly, each constructed in accordance with this invention, shown connected together, by clips and connectors constructed in accordance with this invention and with the lower board assembly mounting the exemplary accessory tray shown in FIGS. 1A and 1B.

For applications where the panel assembly 24 is a multi-layer construction, the panel assembly includes a frame holding a stack of additional panels on the base panel. That frame is best seen in FIG. 3F and is a square or rectangular shaped member which is of L-shape in cross-section and which can be formed of any material, e.g., an extrusion of aluminum plastic. In the exemplary embodiment of FIG. 3F the frame 24B is shown holding a stack of three rectangular panels 24C, 24D and 24E, which constitute the other panels of the panel assembly 24. The panel 24C is a planar panel rectangular shaped member (but could be square shaped) formed of any suitable material, e.g., plastic, and which is shaped and sized to fit within the confines of the frame 24B. Disposed over the panel 24C is an intermediate panel 24D, which is a planar panel of the same size and shape as the panel 24C, and which is formed of corrugated cardboard or corrugated plastic. The intermediate panel 24D serves the purpose of a space or filler so as to keep all panel widths the same. Disposed over the intermediate panel 24D is a planar front or face panel 24E, which is of the same size and shape as the panel 24D, and which can be formed of any particular material or any particular construction, e.g., a dry-erase material, a cork-board material, a chalk-board material, galvanized metal, a fabric (e.g., linen) wrapped board, a slat-board, a letter-board, or any other material or construction that suitable for a desired purpose. In the exemplary embodiment shown in FIG. 1A the front or face panel 24E is in the form of a dry-erase material so that the board assembly 22A serves as a dry-erase board, such as could be found in schools, offices, homes, hospitals, etc.

Figure 25:
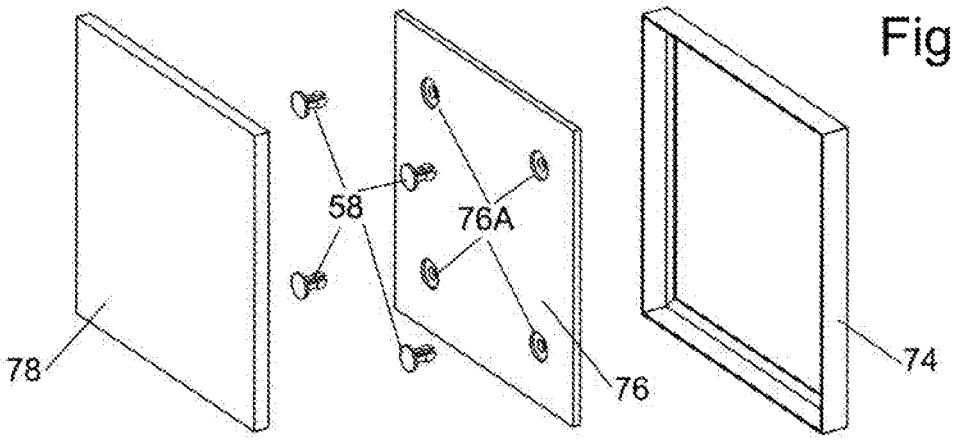
FIG. 25 is an enlarged exploded isometric view of the components making up the insert panel assembly of FIG. 24.

The frame 24B with the panels 24C, 24D and 24E located therein can be secured to the front surface of the base panel, e.g., peg-board 24A, by use of plural snap-connector pins 58 extending through respective apertures or holes in the panel 24C and into apertures or holes 24A' (FIG. 10B) in the peg-board. To that end, as can be seen in FIG. 27, each pin 58 includes a flattened head 58A from which a split shaft 58B projects. The distal end of the split shaft is in the form of two split portions 58C, the free ends 58D of which are slightly bulbous. The outer diameter of the split shaft of the pin 58 is smaller than the inner diameter of the apertures or holes 24A' in the peg-board 24A. As can be seen in FIG. 25 the flattened head of the pin 58 can be located on the inner surface of the panel 24C contiguous with an aperture or hole in that panel and with the split shaft extending through that aperture or hole. The bulbous free ends 58D of the split shaft which exit the hole or aperture in the panel 24C can then be introduced into an aligned aperture or hole 24A' in the peg-board, whereupon the split portions 58C of the pin flex somewhat towards each other to enable them to pass through the hole 24A' and then spring back. This action releasably locks the pin 58 in the aperture or hole 24A' thus releasably securing the frame 24B and its panels 24C, 24D and 24E to the peg-board 24A. If the unit comprising the frame 24B and its panels 24C, 24D and 24D is desired to be removed from the peg-board base panel, that can be readily accomplished by pulling the frame away from the peg-board, whereupon the split portions 58C of the pins again flex toward each other, thereby enabling the bulbous ends 58D to pass back out of the aperture or hole 24A' in the peg-board, thereby freeing the frame and its panels from the peg-board.

The details of the construction of the frame assembly 26 will now be described with reference to FIGS. 2 and 3F. As mentioned earlier the frame assembly 26 includes a plurality of frame sections 28 which are interconnected by a plurality of corner nodes 30. Each of the frame sections 28 is an elongated linear member of any suitable length, e.g., 10 inches, 15 inches and/or 20 inches, etc., and is formed of any suitable rigid material, e.g., aluminum, but could be any other materials. For example if the frame sections are of a short length, e.g., 10 inches, and the materials making up the panel assembly 24 are relatively light in weight the frame sections 28 may be formed of a plastic material. The frame sections may be formed as an extrusion or by molding, depending upon the material used.

Each frame section 28 is of a hollow construction of generally rectangular cross section including a front wall or face 28A, a rear wall or face 28B, a top or inner wall or face 28C, a bottom or outer wall or face 28D, and an intermediate wall 28E located between the top and bottom walls. A short height planar vertical flange 28F projects upward from intermediate wall 28E and is preferably flush with the rear wall 28B. However, the vertical flange 28F may be parallel and closely adjacent the rear wall, if desired. A tall height planar vertical flange 28G projects upward from the intermediate wall 28E between the front and rear walls and separated from the top wall 28C by a gap 28H. A short width horizontal planar flange 281 projects from the flange 28G parallel to the intermediate wall 28E and towards the flange 28F. The flange 281 terminates in a thickened edge including a recess 28J extending the length of the thickened end of the flange 281.

The walls 28A, 28B, 28D and 28H of the frame section bound a rectangular passageway 28K extending the length of the frame section and which is of any suitable size, e.g., ⅞ inch by ⅜ inch to accommodate a projecting portion or projection 30G of a corner node 30 (to be described later) to connect two frame sections together to form a corner of the frame assembly 26. Moreover, the rear wall 28B of each frame section 28 includes a small hole or aperture 28L in communication with the passageway 28K to accept a detent mechanism (to be described later) on the projecting portion 30G of the corner node which it will receive so that the projection of the corner node snap-fits to the frame section to releasably secure the frame section to the corner node, as will also be described later.

When three of the frame sections are connected together to form a generally U-shaped subassembly, the board assembly can be inserted into that subassembly, with the gap 28H of each frame section 28 receiving a respective portion of the peripheral edge of the peg-board panel 24A. The remaining (the fourth) frame section can then be juxtaposed so that the peripheral edge of the peg-board panel is received within the gap 28H of that frame section and that frame section can then be secured to the unsecured projections of the two nodes adjacent the ends of that frame section, whereupon the front surface of the tall flange 28G of each frame section serves as a back stop for the peg-board panel 24A.

As will be described later the top or free edge of the flange 28F serves as a means for enabling clips constructed in accordance with this invention to mount an accessory, e.g., a tray like the tray shown in FIGS. 1A and 1B, onto the board assembly 22A. Moreover, that free edge of the flange 28F also serves as a means for enabling connector clips like those disclosed in our heretofore identified patent application to connect the board assembly 22A to a second board assembly 22B like shown in FIG. 3A. The board assembly 22B is similar in construction to the board assembly 22A, but is slightly different in size and shape.

Figure 2A:
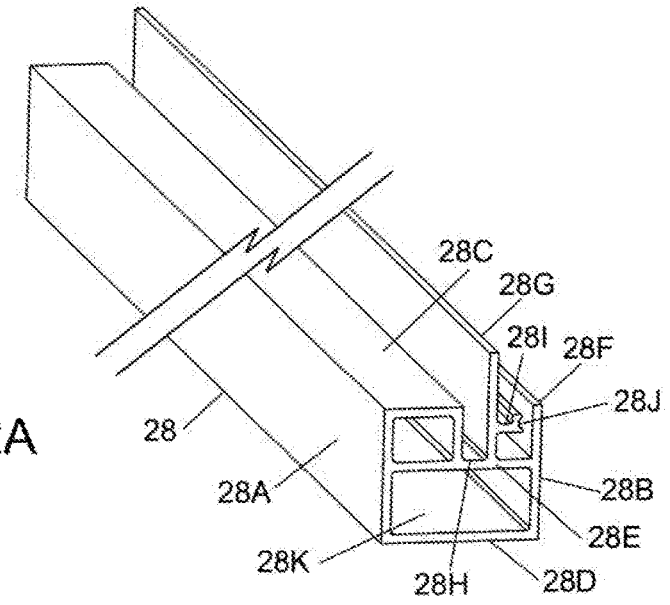
FIG. 2A is an enlarged isometric view, partially broken away, of an elongated frame section forming a portion of a frame assembly of the first board assembly shown in FIGS. 1A and 1B.
Figure 2B:
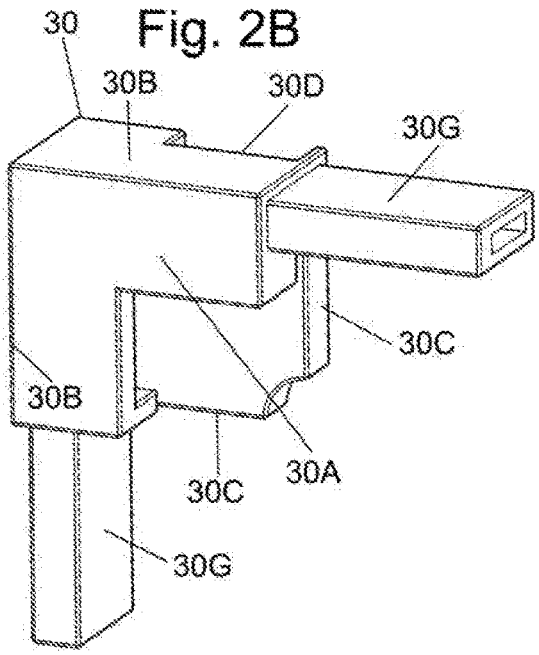
FIG. 2B is an enlarged front isometric view of one corner node forming a portion of the frame assembly of the first board assembly shown in FIGS. 1A and 1B.
Figure 2C:
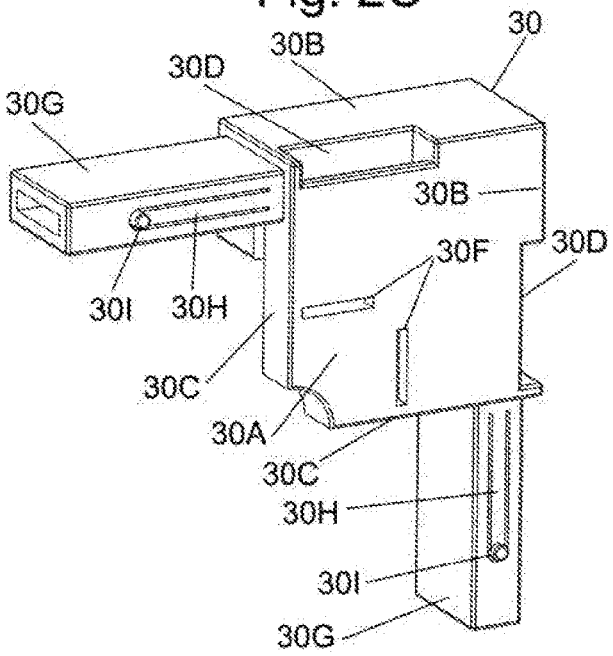
FIG. 2C is an enlarged rear isometric view of the corner node shown in FIG. 2B.

Turning now to FIGS. 2B and 2C, the details of the corner nodes 30 will now be described. Each corner node 30 of this invention is somewhat similar to the corner node of our aforementioned patent application. However, unlike the corner nodes of our aforementioned patent application the projecting portion 30G of each corner node 30 includes the heretofore mentioned detent mechanism, so that each corner node is configured to snap connect two adjacent frame sections together to form a respective corner of the frame assembly 26. Each corner node is formed of any suitable rigid material, e.g., metal or plastic, and can be formed as an extrusion or by molding, and has a generally square shaped body 30A having two outside edges 30B which are planar and which extend perpendicularly to each other. One of the outside edges is horizontal and one vertical. Each corner node also includes two inside edges 30C, which are planar and extend perpendicularly to each other, with one of those inside edges being horizontal and one vertical. A channel 30D extends into the body from each of the outside edges. Each channel terminates at an opening or slot 30F in communication with the back surface 30E. In particular a slot 30F extends parallel to the outside edge 30B from which the associated channel 30D extends.

Each slot 30F is configured to receive a tab of a corner node snap-connector 32 (FIGS. 3B, 3C and 3D) to connect two board assemblies together in a manner similar to that of our aforementioned patent application. Thus, the snap-connector 32 is constructed in accordance with the teachings of our aforementioned patent application, although it is slightly different in construction, e.g., is a bit taller and thicker, and includes some reinforcing or stiffening ridges. The snap-connector 32 is provided to connect a corner node 30 of one board assembly to a corner node 30 of another board assembly, like shown in FIGS. 3A and 3B. In the exemplary embodiment shown in FIGS. 1A and 1B the system 22 includes only a single board assembly 22A. Thus, there is no need for a snap-connector 32.

Turning back to FIGS. 2B-2E it can be seen that each of the inner edges 30C of the body of each corner node 30 includes a pair of the heretofore mentioned projecting portions 30G. Each of those projecting portions (also referred to as a projection) is a hollow member which is of rectangular shape in cross section. Each is configured to be tightly received within a respective passageway 28K of a respective frame section to secure each frame section to the corner node and thus form a respective corner of the frame assembly 26. Thus, the four frame sections 28 of the frame assembly 26 are connected to one another by respective ones of the four corner nodes 30 to complete the frame assembly 26.

Figure 2D:
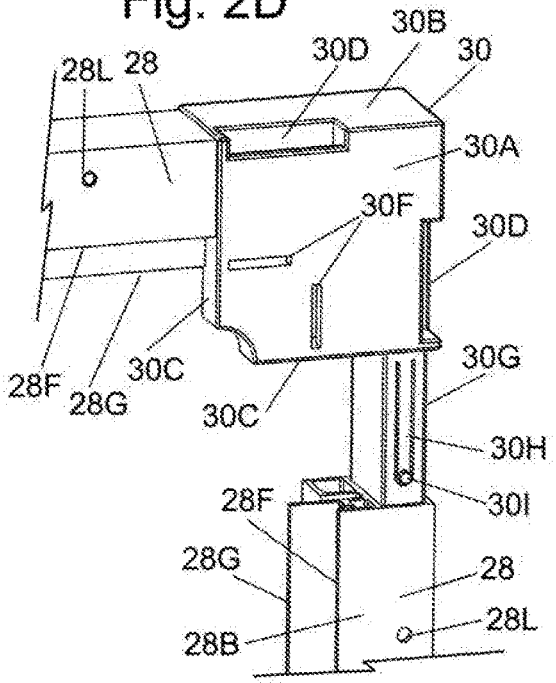
FIG. 2D is an enlarged isometric view showing a corner portion of the frame assembly of the first board assembly shown in FIGS. 1A and 1B in the process of being assembled by a corner node like shown in FIGS. 2B and 2C.
Figure 2E:
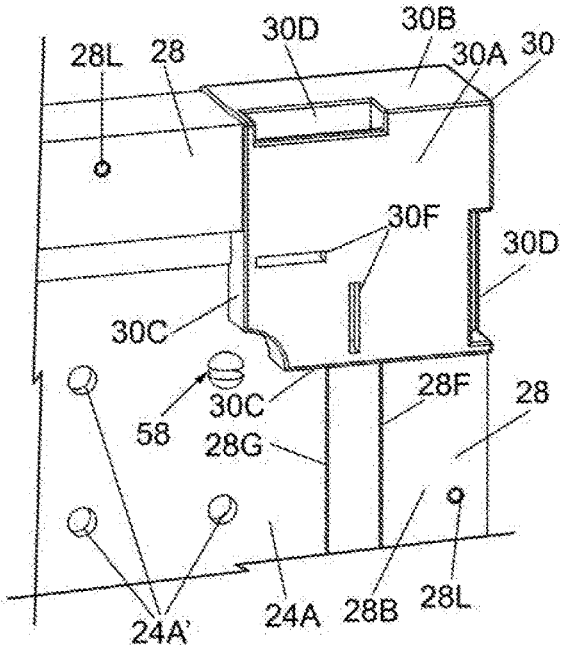
FIG. 2E is an enlarged isometric view showing a corner portion of the frame assembly shown in FIG. 2D after having been assembled to hold a planar panel of the first board assembly.

As best seen in FIGS. 2C and 2D the back surface of each projection 30G includes the heretofore mentioned detent mechanism to effect the snap-fitting of the frame section to the corner node. That detent mechanism is in the form of a spring finger 30H terminating in a thickened or bulbous end 301. Each finger is configured to flex slightly inward into the hollow interior of the projection as the projection is extended into the passageway 28K of the adjacent frame section until the bulbous end 301 reaches the aperture or hole 28L, whereupon the finger flexes outward so that the bulbous end 301 snaps into the aperture 28L, thereby snap-connecting the projection to the frame section. It should be noted at this juncture that any frame section can be disconnect from its associated corner node projection by pressing on the bulbous end 301 of the spring finger extending out of the aperture or hole 28L to cause the finger to flex inward. This action frees the bulbous end 301 from the aperture or hole 28L, whereupon the projection 30G can be withdrawn from the passageway 28K in the frame section thereby separating the frame section from that corner node.

Figure 3B:
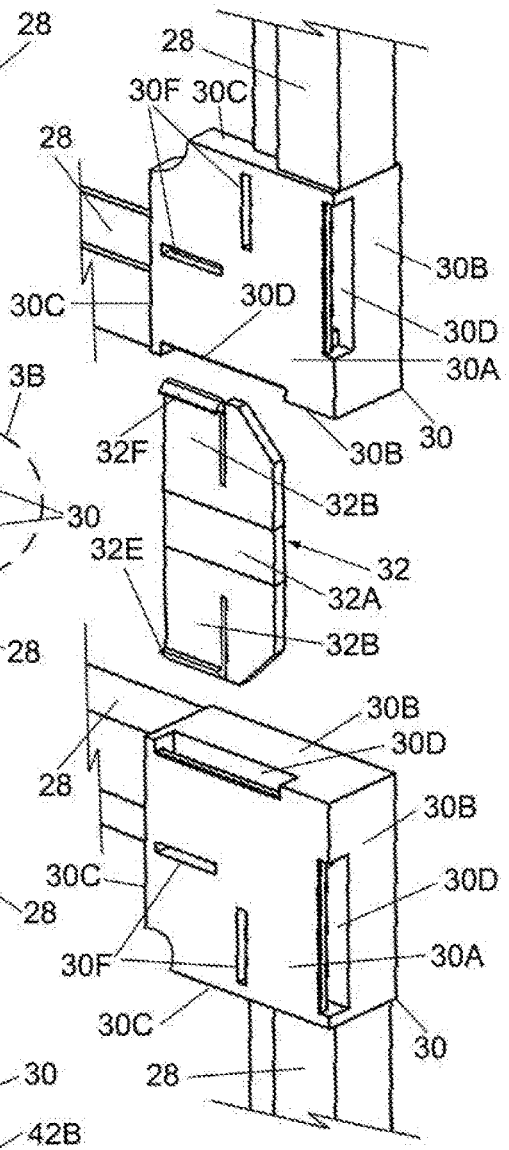
FIG. 3B is an enlarged exploded isometric view of the portion of the modular wall organization system shown within the broken circle identified by the reference number 3B as shown in FIG. 3A.
Figure 3C:
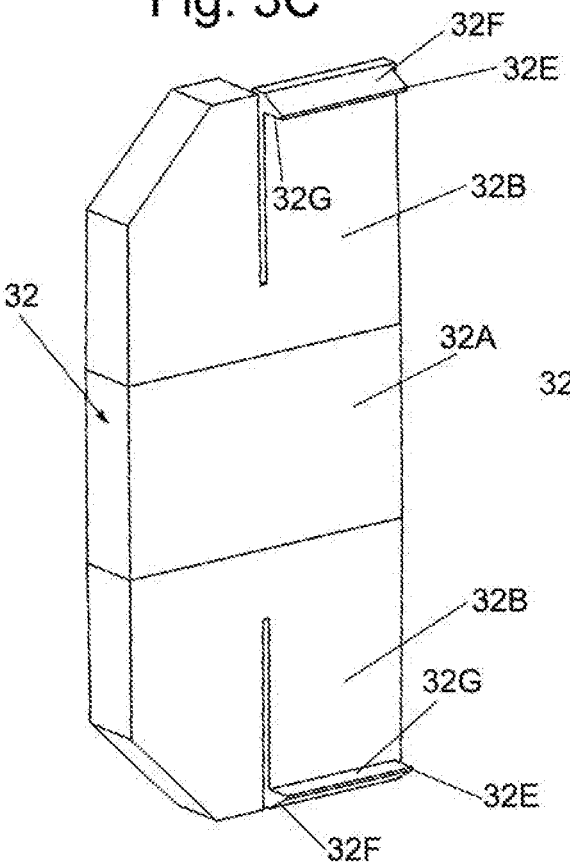
FIG. 3C is an enlarged front isometric view of a snap connector shown in FIG. 3B for connecting a corner node of the first board assembly to a corner node of the second board assembly as shown in FIG. 3A.
Figure 3D:
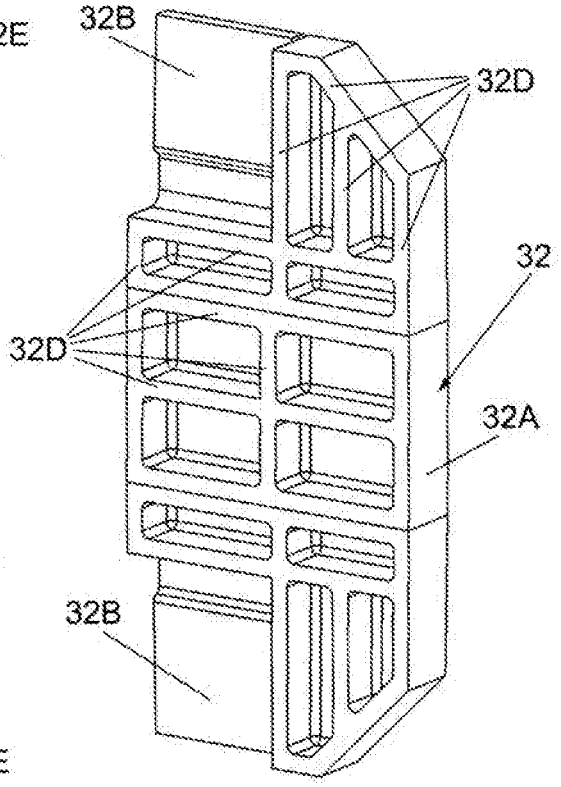
FIG. 3D is an enlarged rear isometric view of a snap connector shown in FIG. 3C.

Turning now to FIGS. 3B-3D the construction of the corner node snap-connector 32 will now be described. That connector is formed of any suitable material, e.g., metal or plastic, and can be formed as an extrusion or by molding. It basically comprises a thin generally planar body 32A from which a pair of flexible tabs 32B project in opposite directions from each other. As best seen in FIG. 3C, the front surface the body 32A is planar and is of a generally truncated arrowhead shape. The tabs extend perpendicularly to the central portion of the body 32A opposite the truncated arrowhead. As best seen in FIG. 3D the rear surface of the body includes plural interconnecting stiffening or reinforcing ridges 32D. The free end of each of the tabs 30B terminates in a wedge-shaped flange 32E. Each wedge-shaped flange has a sloped surface 32F and a contiguous undercut surface 32G. Each tab is sized and shaped to extend into a respective one of the channels 30D of a corner node 30 so that the tab will flex, whereupon the sloped surface 32F of the flange 32E will ride over the portion of the channel 30D contiguous with a slot 30F, whereupon on the tab will snap-fit into the slot, with the undersurface 32F engaging an edge of the slot, thereby releasably locking the tab in place in the channel.

FIG. 3A shows two board assemblies 22A and 22B connected to each other to form another exemplary wall organization system 120 constructed in accordance with this invention. That exemplary wall organization system also makes use of a board assembly 22A and a board assembly 22B which are connected together. The board assembly 22B is similar to the board assembly 22A, but is larger in size. The connection of those board assemblies 22A and 220B is accomplished as follows. The corner node 30 of the lower right corner of the assembly 22B is connected to the corner node 30 in the upper right corner of the assembly 22A by a corner node connector 32 in the same manner as described above. The corner node 30 in the lower left corner of the assembly 22B is not connected to the corner node 30 in the upper left corner of the assembly 22A since those corner nodes are not aligned by virtue of the different size of the board assemblies. However the portion of the board assembly 22A adjacent the upper left corner is connected to the board assembly 22B by a connector clip 34 engaging a portion of the flange 28F of the lower frame section of the board assembly 22B to a portion of the flange 28F of the upper frame section of the board assembly 22A.

Figure 3E:
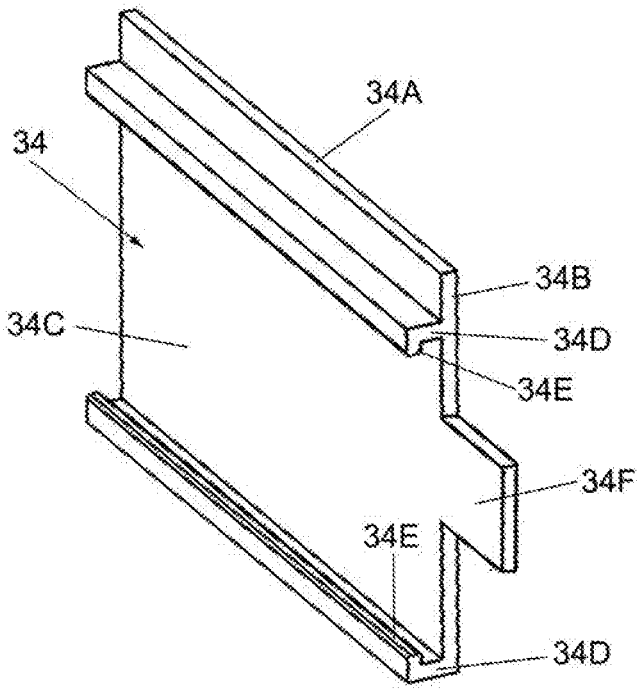
FIG. 3E is an enlarged rear isometric view of a connector clip shown in FIG. 3A for connecting the an elongated frame section of the first board assembly to an elongated frame section of the second board assembly.
Figure 3F:
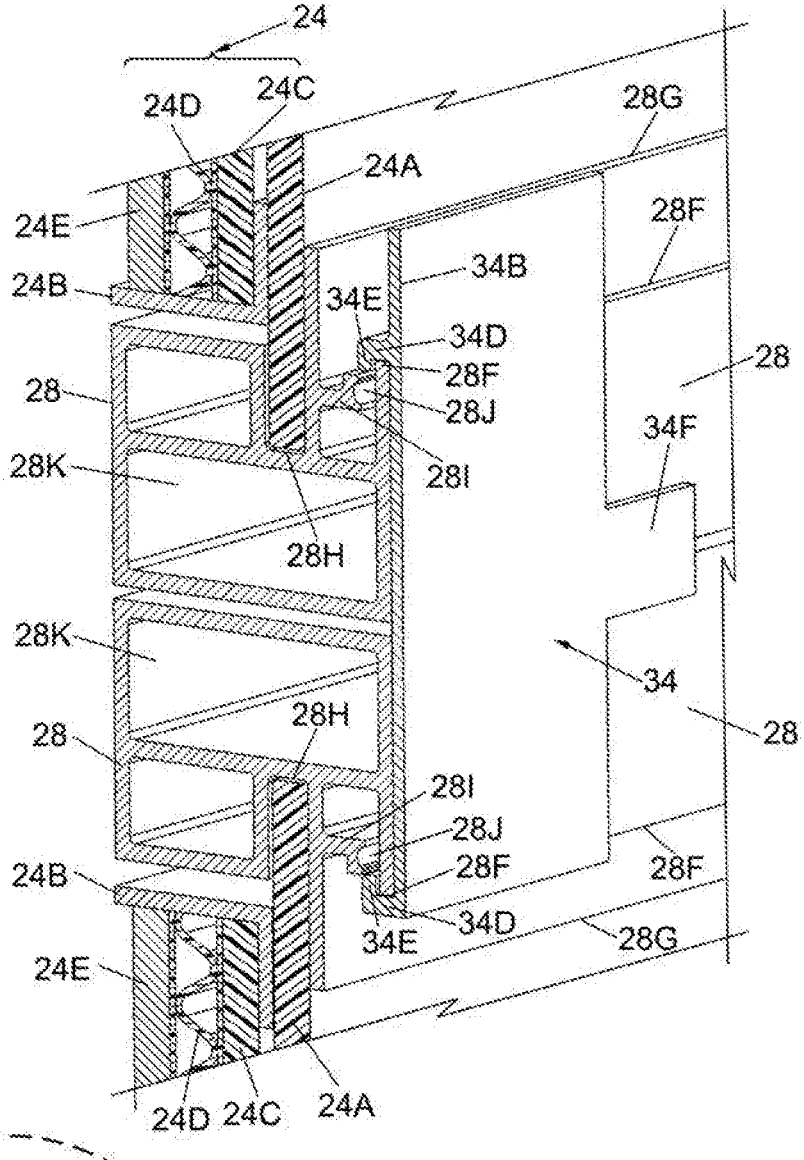
FIG. 3F is a greatly enlarged isometric sectional view taken along line 3F-3F of FIG. 3A.

Before describing how the connector clip 34 is used to connect the board assemblies 22A and 22B together a description of that connector clip is in order. Each connector clip 34 is formed of any suitable rigid material, e.g., metal or plastic, and can be formed as an extrusion or by molding. As best seen in FIG. 3E the connector clip 34 basically comprises a thin, e.g., 1/16 inch, generally planar body 34A having planar back surface 34B and a planar front surface 34C. The front surface includes a pair of rails 34D extending along the width of the connector clip. One of the rails extends along the lower edge of the connector clip and one of the rails extends parallel and slightly below the upper edge of the connector clip. Each rail terminates in a flanged free edge 34E. One of the side edges of the planar body 34A includes a tab 34F. The tab is of the same thickness as the body from which it projects and is of a width enabling it to be inserted into the slot 30F of a corner node 30 of the board assembly 22A to disconnect that corner node from the snap connector 32 connecting the board assembly to the corner node 30 of the board assembly 22B. The tab can then be inserted into the slot 30F of the corner node of the board assembly 22B to disconnect the snap connector 32 from that corner node.

The manner of connecting the flange 28F of the lower frame section 28 of the board assembly 22B to a portion of the flange 28F of the upper frame section 28 of the board assembly 22A will now be described with reference to FIG. 3A. In particular, the connector clip 34 is juxtaposed so that the front surface of it faces the portions of the two frame sections to be connected. The connector clip is then pushed toward the two frame sections, whereupon the flange 34E on the free edge of the upper rail 34D engages the upwardly extending free edge 28F of the frame section 28 of the bulletin board assembly 22B. At the same time the flange 34E on the free edge the lower rail 30D engages the downwardly extending free edge 28F of the frame section 28 of the bulletin board assembly 22A. This action causes the connector clip's body to flex and its rails to spread apart slightly from each other, whereupon the flange on the free edge of the upper rail snaps over the free edge 28F of the frame section of the assembly 22B and into the space between the free edge 28F and the flange 28G while the flange on the free edge of the lower rail snaps over the free edge 28F of the frame section 28 of the assembly 22A. This connects the two frame sections together.

Each connector clip 34 can be disconnected from the frame sections by grasping portions of it contiguous with its two rails and flexing the connector clip to cause the rails to spread apart slightly until their flanges release from the free edges 28F of the frame sections. Once that has occurred, the connector clip can be pulled away and removed from the frame sections. Once the connector clip 34 has been removed from the frame sections, it can be used as a tool to disconnect the corner nodes 30 connecting the assemblies 22A and 22B from each other as described above.

Figure 3G:
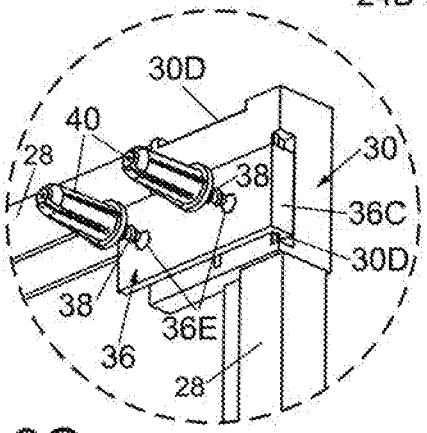
FIG. 3G is enlarged isometric view of the portion of the modular wall organization system shown within the broken circle identified by the reference number 3G of FIG. 3A.
Figure 3H:
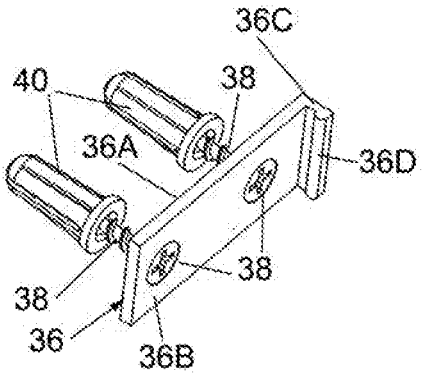
FIG. 3H is an enlarged exploded isometric view of a wall mount clip shown in FIGS. 3A and 3G.
Figure 4A:
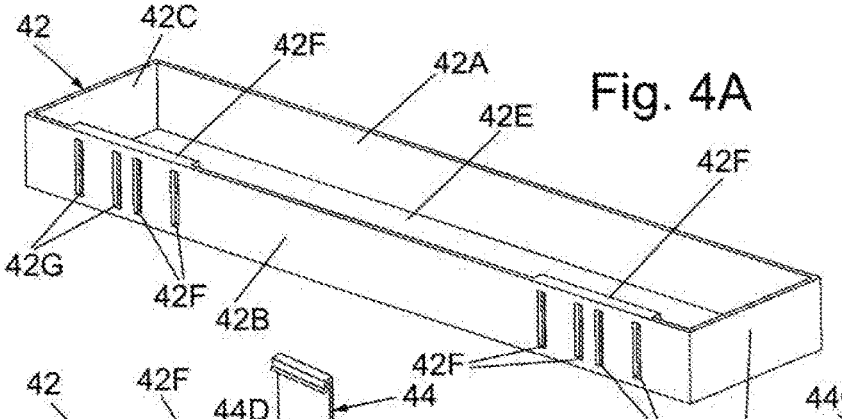
FIG. 4A is an enlarged isometric view of the rear of the tray of the modular wall organization system shown in FIGS. 1A and 1B.
Figure 4B:
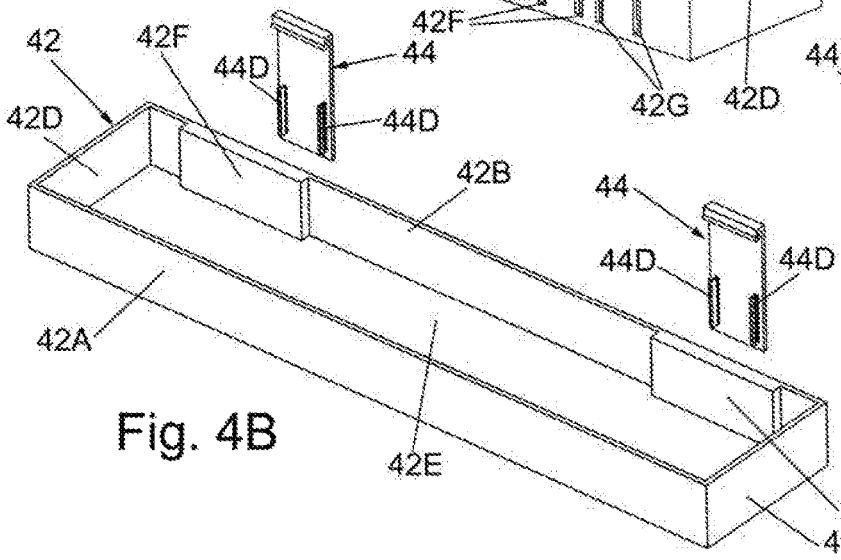
FIG. 4B is an exploded front isometric view of the tray shown in FIG. 4A with a pair of mounting clips for mounting the tray onto the board assembly of the modular wall organization system shown in FIGS. 1A and 1B.

When the board assemblies 22A and 22B have been connected together in their desired orientation, e.g., assembly 22B being located vertically above assembly 22A as shown in FIG. 3A, the assembled wall organization system 120 can then be mounted on a wall (not shown) of a structure. That can be accomplished through use of wall mount clips 36 and associated hardware (to be described shortly and shown in FIGS. 3G and 3H). The wall mount clips 36 are configured to be releasably secured, e.g., snap-fit to the corner nodes 30 of the frame assemblies. Each wall mount clip 36 is formed any suitable material, e.g., metal or plastic, and can be formed as an extrusion or by molding. In any case, as best seen in FIGS. 3G and 3H each wall mount clip 36 basically comprises a thin, e.g., 1/16 inch, planar member having a rear surface 36A, a front surface 36B, and a tab 36C projecting perpendicularly to the front surface along a side edge of the clip. The free end of the tab is in the form of a flange 36D having a sloped outer surface. The flange includes plural holes 36E. The holes are configured to receive respective screws 38 to mount the clip on the wall via conventional wall anchors 40. When the clip 36 is mounted on the wall the tab 36C projects outward. The tab is configured and sized so that the portion of the clip contiguous with the tab can flex outward as the sloped outer surface of the flange rides over the edge of the channel 30D located in a vertical side of the associated corner node 30, whereupon its flange 36D snaps within that channel 30D.

In the example of the system 120 shown in FIG. 3A, the two upper corner nodes 30 of the assembly 22B are each connected to a respective mount clip 36. The mounting of the clips 36 on the wall is accomplished using the screws 38 and wall anchors 40 (if necessary). Once the clips 36 are in place the system 120 which is composed of the connected panel assemblies 22A and 22B is juxtaposed so that the entryways of the channels 30D contiguous with the vertically extending side edges of the corner nodes 30 in the upper right and left corners of the assembly 22B are aligned with the tabs 36C of the two wall-mounted clips. The unit is then pushed against those clips to cause the tabs and contiguous portions to flex, whereupon the sloped surfaces of the flange on each tab slides over the portion of the corner node 30 contiguous with the channel 30D until the flange enters the channel and snaps back (un-flexes) into its normal shape, thereby locking the clip to the corner node.

It should be noted that in lieu of using screws 38 to mount the mount clips 36 on a wall to support a wall organization system of this invention thereon, one can make use of other mounting means. For example, a double sided adhesive pad 84 like shown in FIG. 33A can be secured onto the front surface 36A of each mounting clip used with each corner node. Then the board assembly can be pushed against the wall so that the exposed adhesive surfaces of the pads engage the wall. This action completes the mounting of the board assembly on the wall.

It should be pointed out at this juncture that in lieu of using a self-stick adhesive as the outer surface 36A of the mount clip 36, the outer surface of those clips may be in the form of a VELCRO® connector patch (or any other commercially available multi-hook type or the multi-loop type connector patch), for releasable engagement with a cooperating VELCRO® patch on the wall or other static structure on which the system of this invention is to be mounted.

As should be appreciated by those skilled in the art, the wall organization system 20 can be mounted on a wall in the same manner that the system 120 can be mounted on a wall. In such a case the a mounting clip 36 can be used with each of the upper two corner nodes 30 of the frame assembly 26 making up the board assembly 22A. In fact, the mounting clips 36 can be used to mount any board assembly making use of a frame assembly 26 onto a wall of a structure.

Removal of the wall organization systems 20, 120 (or any other system using a frame assembly including corner nodes 30 and associated mount clips 36) can be readily accomplished by flexing the tabs of the mount clips 36 so that they are released from the channels of the corner nodes in which they are located, whereupon the entire system can be removed from the wall.

Figure 7:
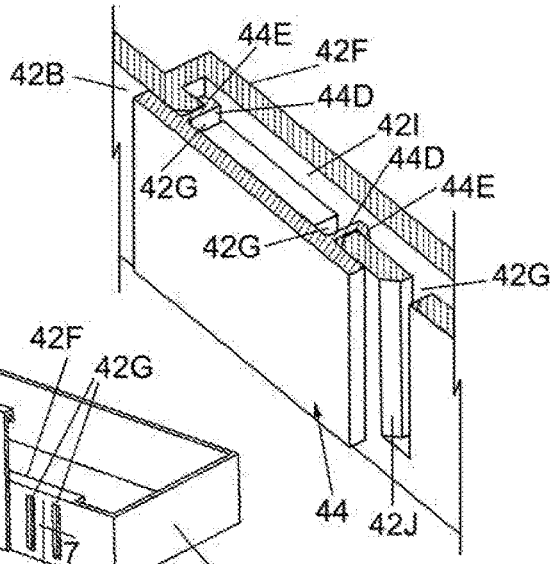
FIG. 7 is an enlarged sectional view taken along line 7-7 of FIG. 5.
Figure 5:
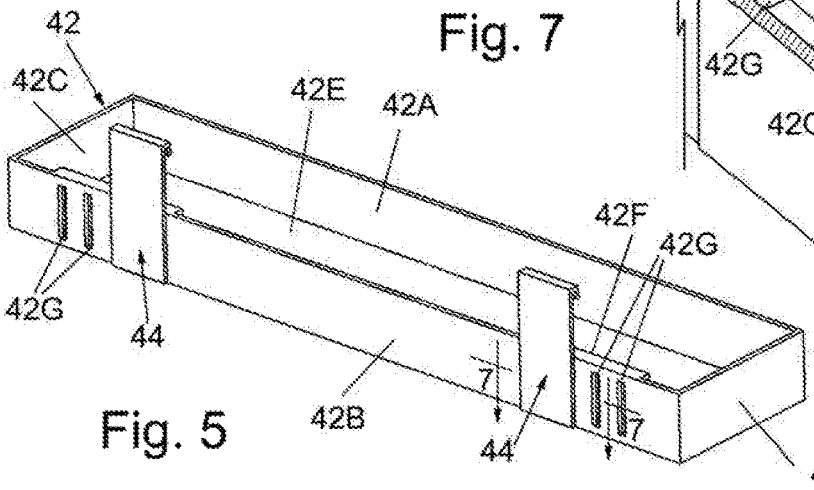
FIG. 5 is a rear isometric view of the tray and mounting clips after they have been assembled together and are ready to be mounted on the board assembly of the modular wall organization system.

As mentioned above the wall organization systems of this invention can include various types of accessories for use with the board assemblies. For example, the board assembly 22A of the systems 20 and 120 each includes an accessory tray 42 mounted thereon. That tray is merely one example of various trays and other accessories that can be mounted on the board assemblies by hanger clips constructed in accordance with this invention. In the exemplary embodiment shown in FIGS. 1A, 1B the tray is an elongated rectangular member, whose details are best seen FIGS. 3A, 4A, 4B and 5. The tray 42 is connected, i.e., suspended, from the bottom frame section 28 of the board assembly by a pair of hanger clips 44. The tray 42 includes a peripheral sidewall including a front wall 42A, a pair of end walls 42B and 42C, and a rear wall 42D, all of which project upward from a base wall 42E. Each of the walls 42A-42D is of the same height and is a planar member of constant thickness, except for the rear wall. In this regard, the rear wall includes a thickened section 42F located adjacent the end wall 42B, and an identical thickened section 42F adjacent the end wall 42C. The thickened sections project inwardly from the inner surface of the rear wall, with the outer surface of the rear wall being planar. Two pair of vertically oriented slots 42G and 42H extend from the outer surface of the rear wall into communication with a hollow cavity 42I (FIG. 7) located within the thickened sections 42F adjacent the end walls 42B and 42C. The slots are configured to receive flanged portions (to be described shortly) of the hanger clips 44. The outermost edge of each slot of each pair of slots is in the form of a chamfered or sloped surface 42J to facilitate the entry of the flange portions of the hanger clips, as will be described later.

Figure 6:
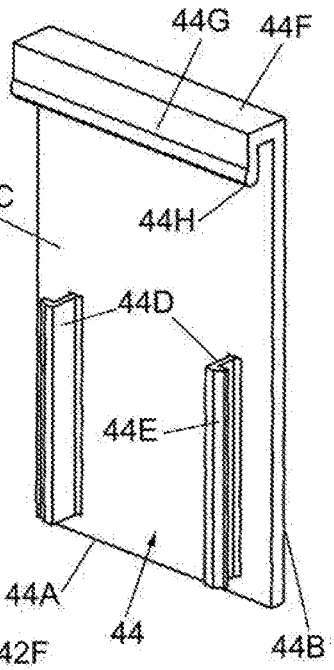
FIG. 6 is an enlarged rear isometric view of one of the clips shown in in FIGS. 4B and 5.

Each hanger connector clip 44 is formed of any suitable rigid material, e.g., metal or plastic, and can be formed as an extrusion or by molding. As best seen in FIG. 6 the hanger clip 44 basically comprises a thin, e.g., 1/16 inch, generally planar elongated body 44A having planar back surface 44B and a planar front surface 44C. The front surface includes a pair of rails 44D extending along approximately the lower half of the height of the clip. Each rail terminates in an outwardly directed flanged free edge 44E whose outer surface is sloped. The top end of the hanger clip is in the form of a hook 44F having a downwardly extending flange 44G. The flange 44G includes a bulbous elongated ridge 44H extending along the outer surface of the flange at its free end. The hook 44F is configured to be extended over the upwardly projecting flange 28F of the frame section 28 to mount the hanger clip on that frame section as will be described later.

One hanger clip 44 can be connected to either of the pair of slots 42G or 42H adjacent the end wall 42B of the tray 42, while a second hanger clip 44 can be connected to a corresponding pair of slots 42G or 42H adjacent the end wall 42C of the tray 42, depending upon the length of the tray and the length of the frame section 28 onto which the tray is to be mounted. In any case the securement of each clip to the tray is accomplished as follows. The clip is juxtaposed opposite the selected pair of slots 42G or 42H with the rails 44D of the clip aligned with the selected pair of slots. The hanger clip is then pushed toward the back surface of the wall 42B of the tray so that the sloped surface 44E of each of the rails engages and slides over the chamfered surfaces 42J (FIG. 7) of the slots 42G or 42H, whereupon the rails flex inwards toward each other until the flanged ends of the rails enter into the cavity 42I. At that point the rails snap back to lock into place, thereby resulting in the snap-connection of the hanger clip to the back wall of the tray.

With both of the hanger clips 44 being secured to the back wall of the tray 42, the tray is now ready to be mounted onto the frame section 28 of the particular board assembly to which it is to be suspended. That action is achieved as follows and is best understood by reference to FIGS. 8A-8C. In particular, FIG. 8A shows the board assembly 22A ready to have the tray 42 mounted thereon by the hanger clips secured to the tray. In particular, the tray with the hanger clips mounted thereon is juxtaposed so that the hooks 44F are located slightly above the free edge of the upstanding flange 28F of the frame section 28. The tray and the clips are then moved downward as a unit so that the flanges 44G of the clips enter into the space between the frame section's upstanding flanges 28F and 28G until the bulbous ridge 44H snaps into the elongated groove or recess 28J of the frame section like shown in FIG. 8C. That action completes the mounting or suspension of the tray onto the board assembly.

Removal of the tray from the board assembly, when desired, can be readily accomplished by pivoting the tray backward slightly with respect to the board assembly while lifting the tray upward slightly. That action causes the ridge 44H to exit the recess 28J, thereby freeing the clips from the flange 28F of the frame section so that the hook 44F portions of the clips can be lifted off of the flange 28F.

As should be appreciated by those skilled in the art, when a wall organizing system making use of at least one panel assembly like those described above is mounted on a wall there will be a gap between the back surface of the base panel 24A of the panel assembly and the front surface of the wall. Thus, if the board assembly is large, e.g., 20 inch or more square, and the panel assembly 24 is somewhat flexible, as could be the case if the panel assembly was composed of only one panel, e.g., a peg-board, pressing on the peg-board from the front to insert some pegs therein could flex or sag the board result in the release of some items from the peg-board. To avoid that occurrence the wall organization system may include an accessory spacer 46, like shown in FIGS. 8D-8F. That spacer is preferably in the form of a disk formed of any suitable material, e.g., plastic, and is secured to the back surface of the base panel 24A by any suitable means, e.g., epoxy, in approximately the middle of the base panel. The disk is of a thickness, e.g., 0.375 inch, which is approximately the same as the distance between the back surface 28B of the frame sections and the front surface of the wall on which the board assembly is to be mounted plus the thickness of any other component that may be located on the back surface of the board assembly. Such other components can be the wall mount clips 36, the connector clips 34, and the hanger clips 44. Thus, with the spacer disk 46 in place if pressure is applied to the front surface of the board assembly it will not flex or sag inward since the spacer disk will be interposed between it and the wall.

Figure 9A:
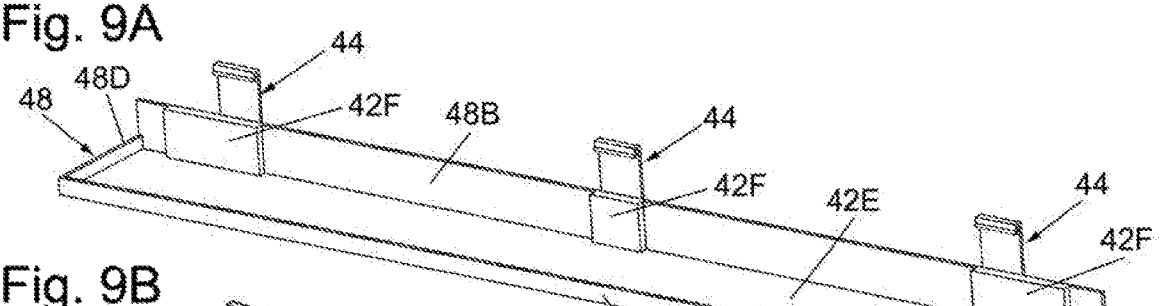
FIG. 9A is an isometric view of the alternative exemplary accessory tray shown in FIG. 8A.

It should be noted that the board assembly 22A shown in FIG. 8D is shown with a different accessory tray 48, mounted thereon. That accessory tray is best seen in FIG. 9A and is very similar in construction of the tray 42, except that its front wall 48A, end walls 48B and 48C and its rear wall 48B are slightly different, i.e., of a lower height. In the interest of brevity the common features of the construction of the tray 48 with the tray 42 will be given the same reference numbers and details of those features and the manner of mounting the tray 48 on the board assembly by clips 44 will not be reiterated. Thus, as best seen in FIG. 9A the rear wall 48B of the tray 48 includes the two heretofore identified thickened sections 42F and the associated pairs of slots 42F and 42G therein (although those slots cannot be seen in FIG. 9A) with a third thickened section 48F constructed similarly to the thickened sections 42F, but of narrower width, located in the middle of the rear wall 48B between the outer thickened sections. The middle thickened section 48F includes only one pair of slots 42F therein for receipt of the rails of a third hanger clip 44 as shown in FIGS. 8D and 9A.

Figure 9B:
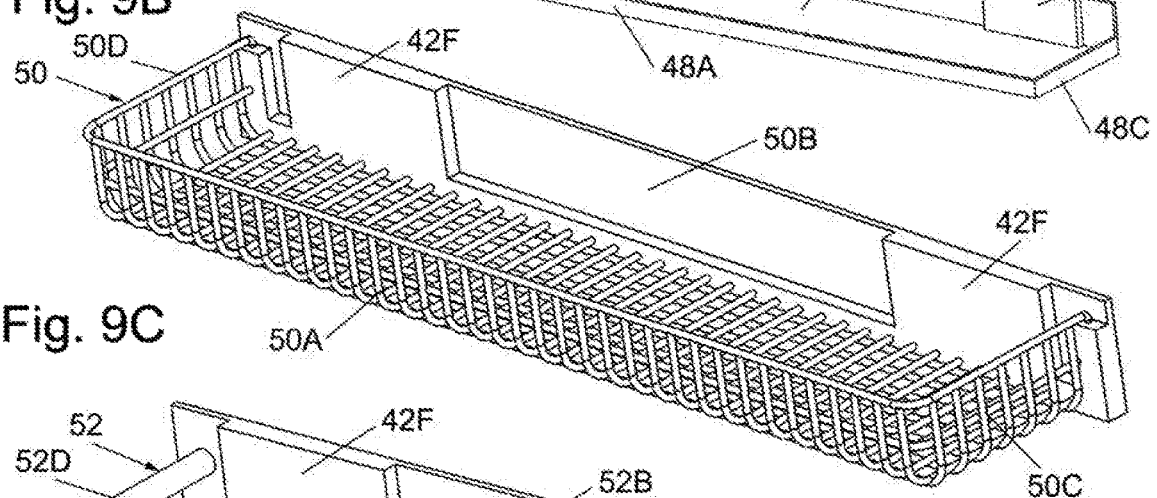
FIG. 9B is an isometric view of another exemplary alternative accessory tray constructed in accordance with this invention, i.e., a basket-type tray.

FIG. 9B shows still another embodiment of an accessory tray 50 constructed in accordance with this invention. The tray 50 is in the form of a basket having a rear wall 50B from which an interlaced multi-wire basket projects outward. The basket comprises a front wall 50A, a pair of end walls 48C and 48D, and a bottom or base wall 48E. The front wall and end walls are all of the same height which is less than the height of the rear wall. The basket's interconnected wires may be formed of metal or plastic. The rear wall 50B is constructed somewhat similarly to the rear wall 42B of the tray 42 in that it includes two thickened sections 42F and the associated pairs of slots 42F and 42G therein (although those slots cannot be seen in FIG. 9B). In the interest of brevity the details of those common features and the manner of mounting the tray 40 on the board assembly by clips 44 will not be reiterated.

Figure 9C:
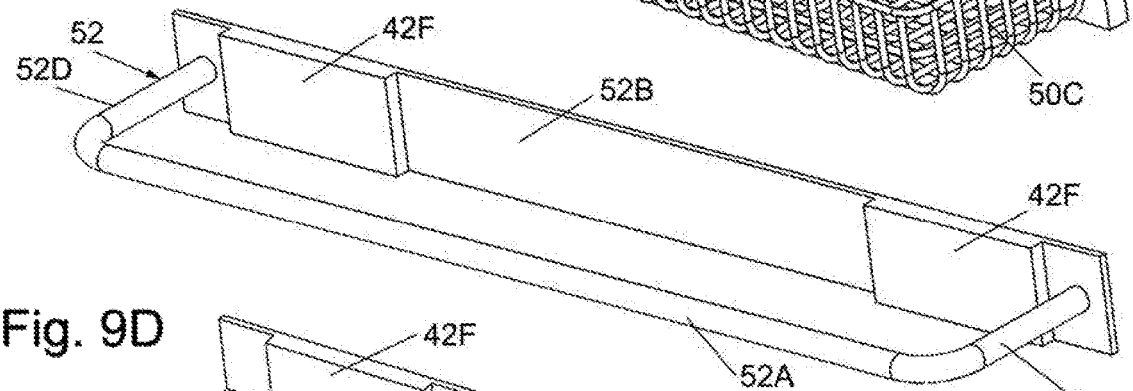
FIG. 9C is an isometric view of another alternative exemplary embodiment of an accessory constructed in accordance with this invention, i.e., a hanger bar.

FIG. 9C shows still another embodiment of an accessory 52 constructed in accordance with this invention. The accessory 52 is in the form of a generally U-shaped hanger bar having a front section 52A and a pair of end sections 52C and 52D. Each of the end sections is secured to a respective portion of a rear wall 52B. The rear wall 52B is constructed somewhat similarly to the rear wall 42B of the tray 42 in that it includes two thickened sections 42F and the associated pairs of slots 42F and 42G therein (although those slots cannot be seen in FIG. 9B). In the interest of brevity the details of those common features and the manner of mounting the accessory 52 on the board assembly by clips 44 will not be reiterated. The hanger bar can be used to hang or suspend any item thereon.

Figure 9D:
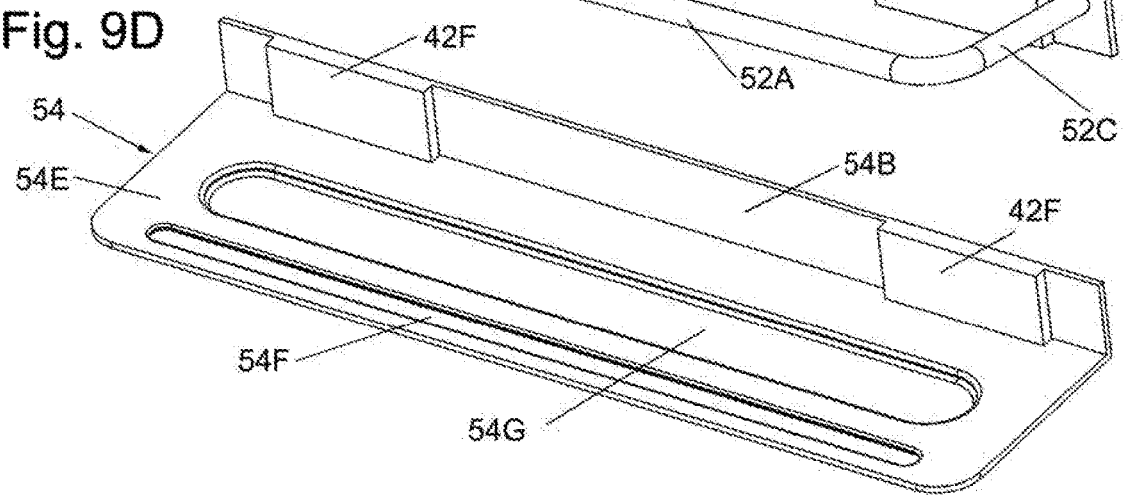
FIG. 9D is an isometric view of another exemplary alternative accessory tray constructed in accordance with this invention, i.e., a dual-recess tray.

FIG. 9D shows yet another embodiment of an accessory 54 constructed in accordance with this invention. The accessory 54 is in the form of a slotted tray having a generally planar bottom wall 54E projecting outward from a rear wall 54B. The rear wall 54B is constructed somewhat similarly to the rear wall 42B of the tray 42 in that it includes two thickened sections 42F and the associated pairs of slots 42F and 42G therein (although those slots cannot be seen in FIG. 9B). In the interest of brevity the details of those common features and the manner of mounting the accessory tray 54 on the board assembly by clips 44 will not be reiterated. The bottom wall 54E includes two flattened oval recesses 54F and 54G extending almost the full width of the bottom wall. The recess 54G is wider measured front-to-back than the recess or opening 54F and is located between the recess or opening 54F and the rear wall 54B. The elongated recesses are particularly configured to receive relatively long items, e.g., writing instruments, dry-erase markers, brushes, etc., therein.

Figure 10A:
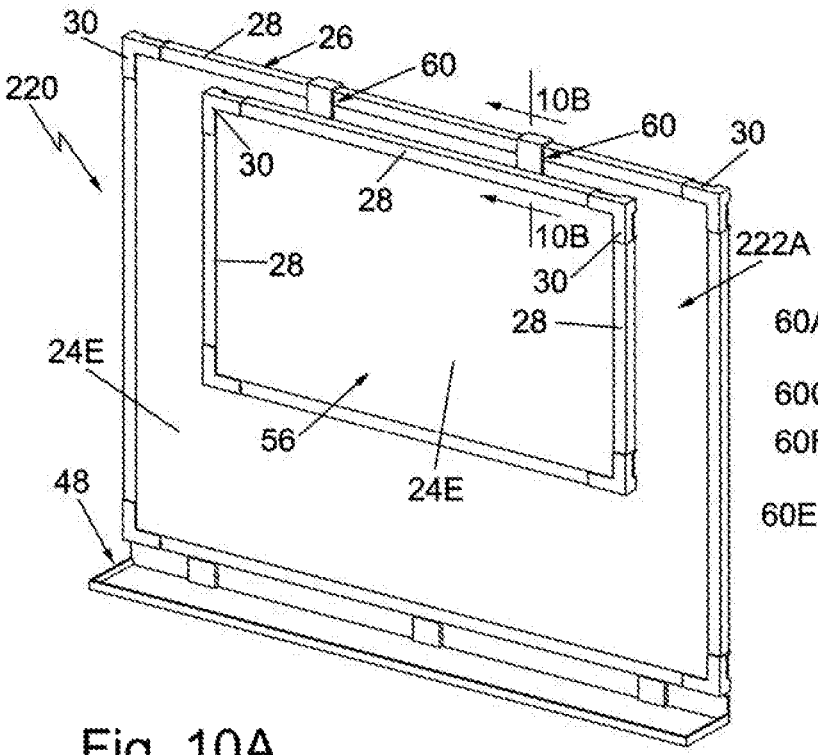
FIG. 10A is front isometric view of another exemplary embodiment of a modular wall organization system constructed in accordance with this invention and including a board assembly mounting an accessory in the form of a panel insert constructed in accordance with this invention and also mounting an accessory tray like that of FIG. 9A thereon.
Figure 10B:
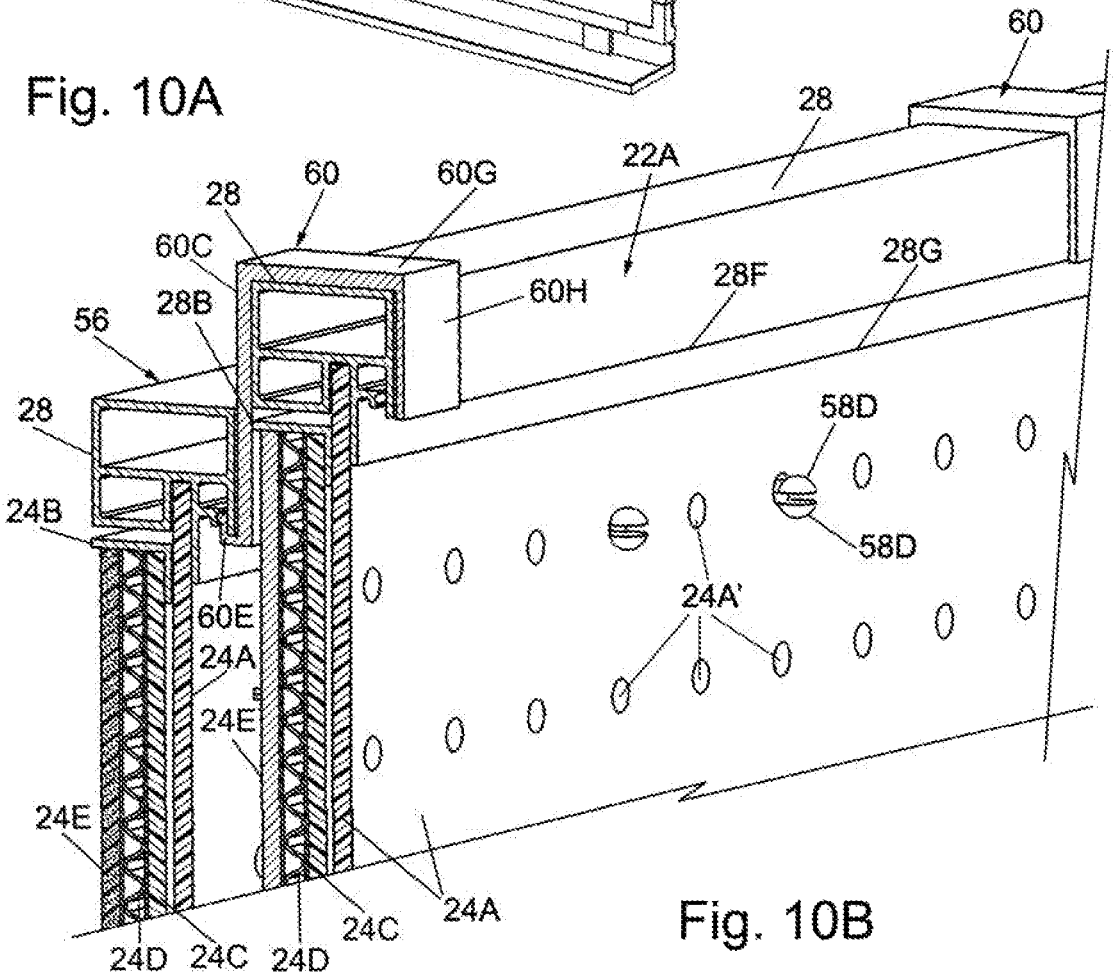
FIG. 10B is an enlarged sectional isometric view taken along line 10B-10B of FIG. 10A.

FIG. 10A shows another exemplary wall organizing system 220 constructed in accordance with this invention. The system 220 basically comprises a board assembly 222A constructed similarly to the board assembly 22A, albeit somewhat wider, with a tray 48 mounted thereon, and with an additional accessory in the form of a cork-board insert panel 56 mounted thereon by a pair of hanger clips 60. In the interest of brevity the common features of the board assembly 222A with the board assembly 22A will be given the same reference numbers and details of those features will not be reiterated. So too the features of the tray 48 and the manner of mounting it onto the board assembly 222A will not be reiterated in the interest of brevity.

The insert panel 56 can be of any type of construction. In the exemplary embodiment shown in FIG. 10A the insert panel 56 it is in the form of a board assembly like the board assembly 22A, albeit smaller in size than the board assembly 222A and with the front panel 24E of its panel assembly 24 being a cork-board panel. In the interest of brevity the common features of the board assembly 222A with the board assembly 22A will be given the same reference numbers and details of those features will not be reiterated. So too, the common features of the insert panel 56 with a board assembly 22A will be given the same reference numbers and details of those features will not be reiterated as can be clearly seen in FIG. 10B.

Figure 11:
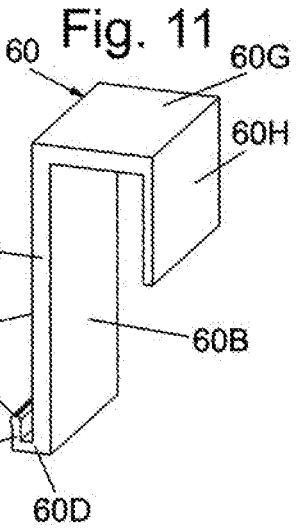
FIG. 11 is an enlarged isometric view of one of two hanger hooks constructed in accordance with invention hanging the accessory panel insert on the board assembly like shown in FIG. 10A.

Each of the hanger clips 60 is of identical construction and configured to suspend the insert panel 56 from the top frame section 28 of the board assembly 220A. FIG. 11 shows one of the hanger clips 56. Thus, as can be seen each hanger connector clip 60 is formed of any suitable rigid material, e.g., metal or plastic, and can be formed as an extrusion or by molding. The hanger clip 60 basically comprises a thin, e.g., 1/16 inch, generally planar somewhat tall body 60A having planar back surface 60B and a planar front surface 60C. The bottom end of the hanger clip 60 is constructed like the top end of the hanger hook 44, except that it is inverted vertically. Thus, the bottom end of the hanger clip 60 is in the form of a hook 60D having an upwardly extending flange 60E having a bulbous elongated ridge 60F extending along the outer surface of the flange at its free end. The top end of the hanger clip 60 is in the form of a hook 60G having a downwardly extending flange 60H. The hook 60G is configured to be extended over the wall 28D of the top frame section 28 of the board assembly 222A, with the body 60A of the hanger clip located in front of the front wall 28A of that frame section. The linear ridge 60F on the upwardly directed flange 60E is snap fit between the inner surface of the flange 28F of the upper frame section 28 of the insert panel 56 and the groove 28J in the horizontal flange 281 of that frame section to releasably secure the insert panel's frame to the hanger clip 60 and hence to the board assembly 222A.

Figure 12:
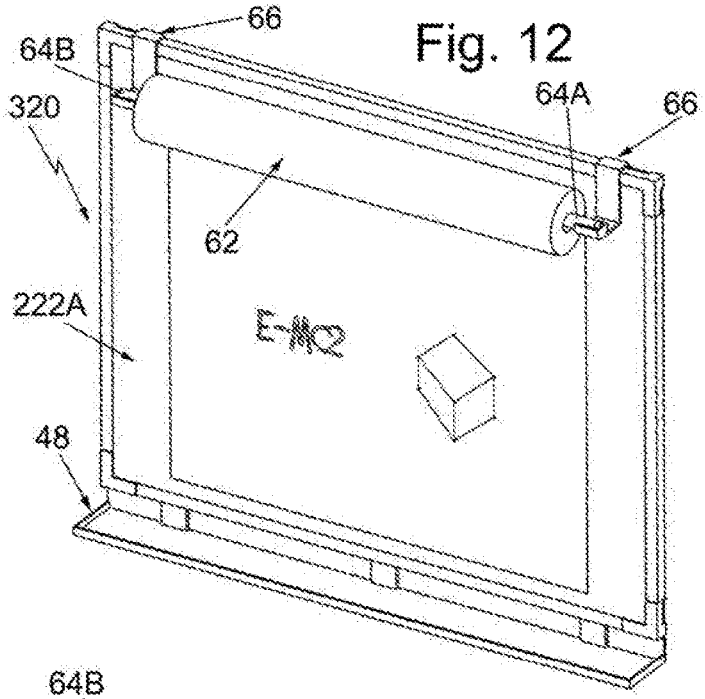
FIG. 12 is a front isometric view of another exemplary embodiment of a modular wall organization system including a board assembly constructed in accordance with this invention and mounting an accessory in the form of a roll of writing material, e.g., paper, constructed in accordance with this invention and also mounting an accessory tray like that of FIG. 9A thereon.
Figure 13:
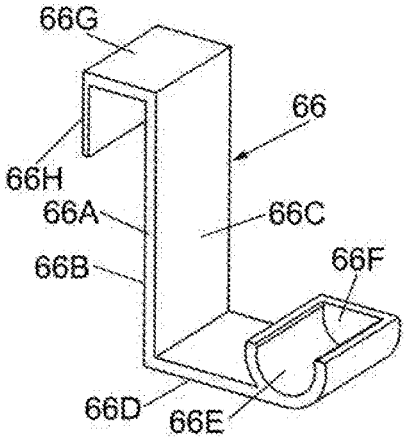
FIG. 13 is an enlarged isometric view of one of the two hanger hooks constructed in accordance with invention for hanging the roll of writing material on the board assembly like shown in FIG. 12.
Figure 14:
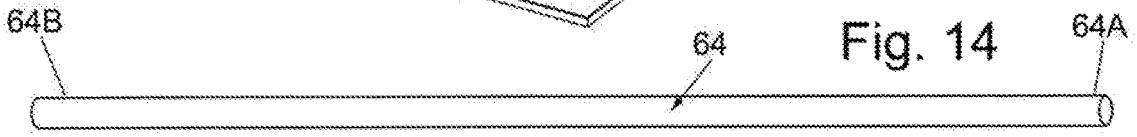
FIG. 14 is an enlarged isometric view of a rod constructed in accordance with invention for use with the hanger hooks of FIG. 13 for hanging the roll of writing material on the board assembly like shown in FIG. 12.
Figure 15:
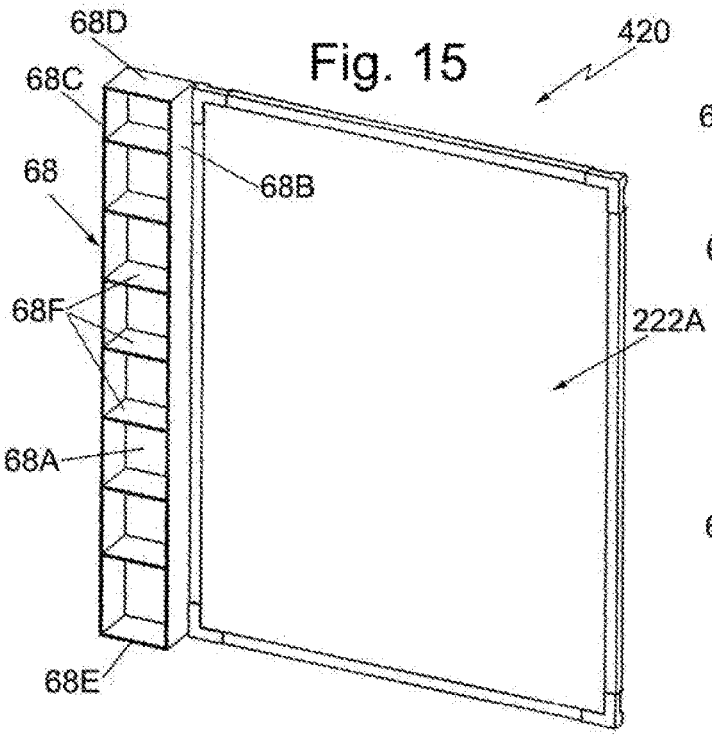
FIG. 15 is a front isometric view of another exemplary embodiment of a modular wall organization system including a board assembly constructed in accordance with this invention and mounting an accessory in the form of a multicompartment cubby-hole unit constructed in accordance with this invention.
Figure 16:
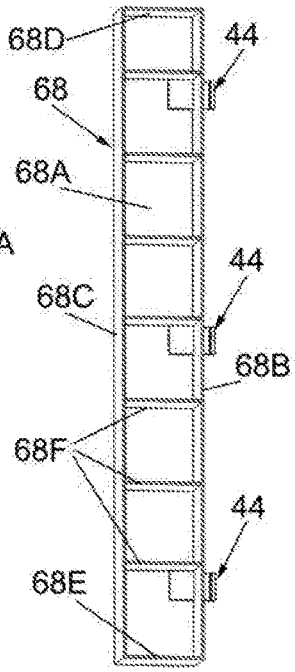
FIG. 16 is a front isometric view of the cubby-hole unit and associated clips for mounting the it on the board assembly shown in FIG. 15.
Figure 17:
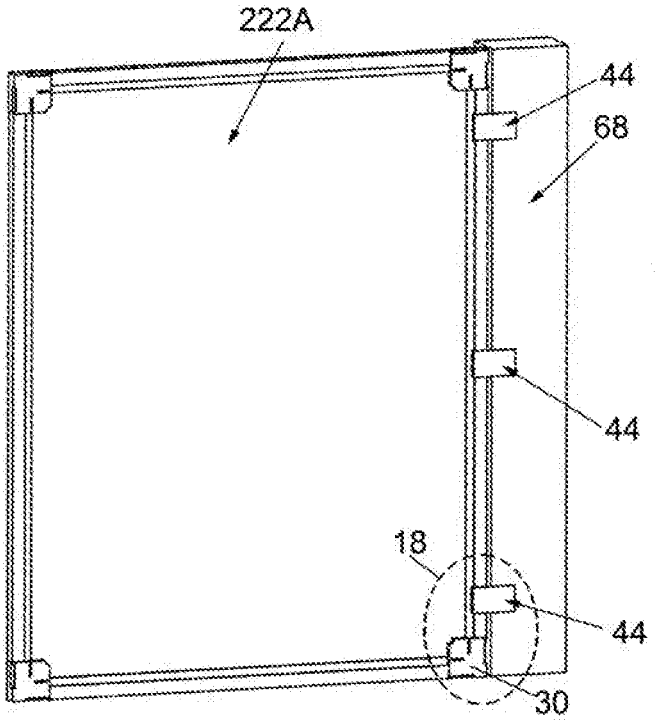
FIG. 17 is a rear isometric view of the modular wall organization system with the cubby-hole unit of FIG. 15 mounted thereon.
Figure 18:
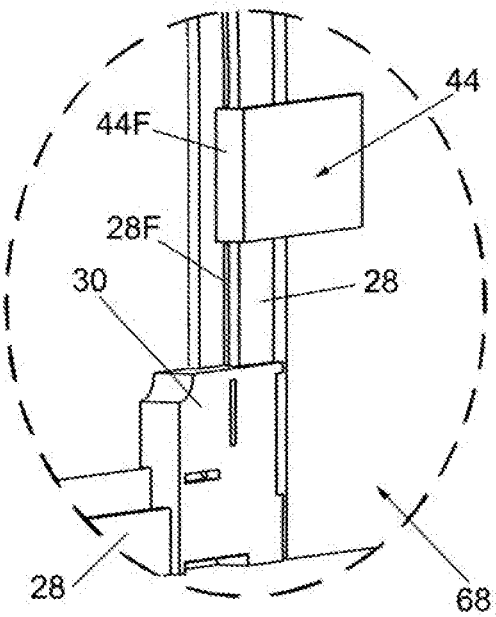
FIG. 18 is an enlarged view of the portion of the modular wall organization system with the cubby-hole unit of FIG. 17 shown within the broken circle designated by the reference number 18 in FIG. 17.

FIG. 12 shows still another exemplary wall organizing system 320 constructed in accordance with this invention. The system 320 basically comprises the board assembly 222A with the tray 48 mounted thereon, and with an additional accessory in the form of a roll 62 of writing material, e.g., paper, mounted on the board assembly by an elongated rod 64 and a pair of rod hanger clips 66. The roll 62 includes a central passageway 62A through which the rod 64 extends. The rod is best seen in FIG. 14 and is elongated member of circular cross-section, formed of any suitable material, e.g., aluminum, having a pair of ends 64A and 64B. The rod hanger clips 66 of the pair are mirror images of each other. FIG. 13 shows the rightmost rod hanger clip shown in FIG. 12. As can be seen it basically comprises a thin, e.g., 1/16 inch, generally planar somewhat tall body 66A having planar back surface 66B and a planar front surface 66C. The bottom end of the rod hanger clip is in the form of flange 66D whose free end is in the form of a curved, e.g., semi-cylindrical, socket 66E having an end wall 66F. The inner diameter of the semi-circular socket is equal to the outer diameter of the end 64A of the rod to receive that end of the rod. The top end of the rod hanger clip 66 is in the form of a hook 60G having a downwardly extending flange 66H. The hook 66H is configured to be extended over the top wall 28D of the top frame section 28 of the board assembly 222A, with the body 60A of the rod hanger clip located in front of the front wall 28A of that frame section adjacent the rightmost corner node 30 and with the flange and its socket facing away from the front of the board assembly 320. The other rod hanger clip is also mounted on the frame section 28 adjacent the leftmost corner node and with the flange and its socket facing away from the front of the board assembly like shown in FIG. 12. Since that other rod hanger clip is the mirror image of the rod hanger clip located adjacent the rightmost corner node the opposite end 64B of the rod 64 can be received within its socket.

The roll of writing material 62 is mounted by extending the rod 64 through the central passageway 62A so that each end 66A and 64B of the rod 64 extends out a respective end of the passageway. The rod end 64A can then be located within the socket 66E of the rightmost rod hanger clip, with the rod end 64B located within the socket 66E of the leftmost rod hanger clip, thereby suspending the roll in front of the front panel of the board assembly 222A. The free end of the roll of writing material can then be pulled down to unwind some of it across the front panel of the board assembly so that one can write something, e.g., a formula and a drawing of a cube, on the exposed unrolled portion like shown in FIG. 12.

Figure 19:
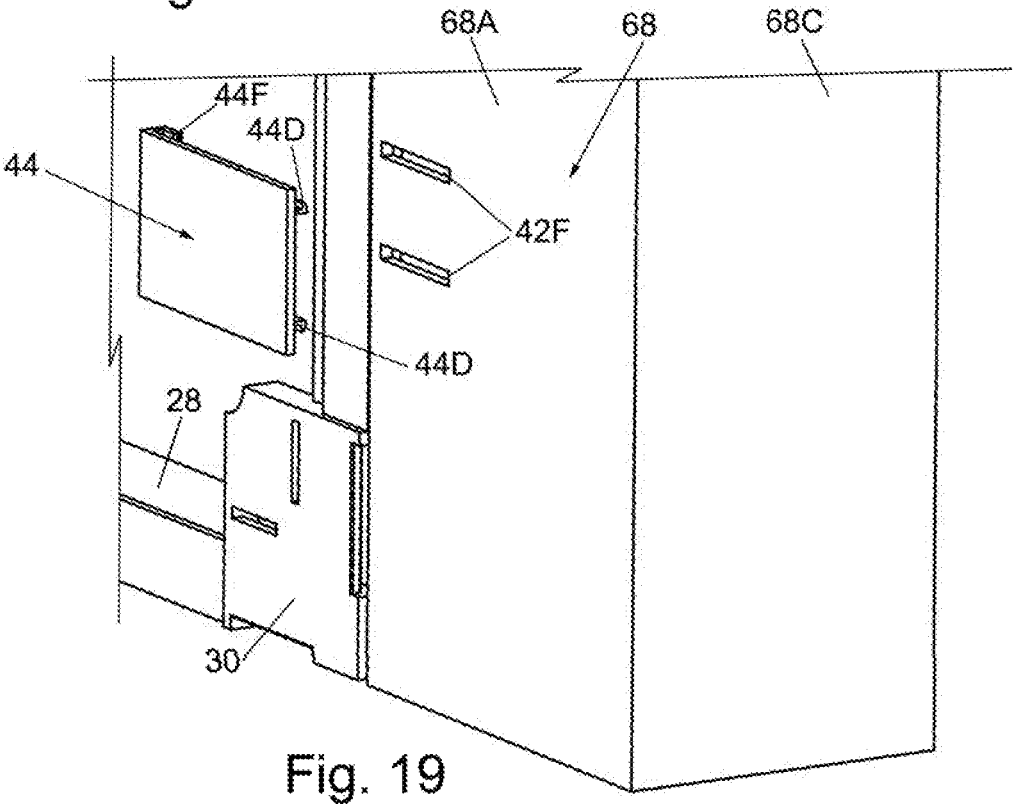
FIG. 19 is an enlarged exploded isometric view showing the manner of connecting the cubby-hole unit to the board assembly of FIG. 15 using clips like shown in FIGS. 6 and 16-18.

FIGS. 15-19 show still another exemplary wall organizing system 420 constructed in accordance with this invention. The system 420 basically comprises the board assembly 222A with an additional accessory in the form of a multi-compartment cubby-hole unit 68, which is mounted on one side of the board assembly by three hanger connector clips 44, like those described above. The cubby-hole unit basically comprises a back wall 68A, a pair of side walls 68B and 68C, a top wall 68D, a bottom wall 68E and a plurality of horizontal shelves 68F equidistantly spaced from one another between the top wall and bottom wall to form plural cubbies of the unit. The shelves may be fixedly secured in place or may be configured to be adjustably mounted at different heights between the top and bottom walls. The three clips 44 are connected to the back wall of the cubby-hole unit. To that end, the back wall includes three pairs of elongated slots constructed like the pairs of slots 42F described above with respect to the accessories 44 and 40-54. One pair of slots 42F is located slightly above the lower right corner node 30 as shown in FIG. 19, whereas a second pair of slots 42F (not visible) is located slightly below the upper right corner node 30 in FIG. 19 and a third pair of slots 42F (not visible) is located between the upper and lower pairs of slots. All of the slots are oriented horizontally. Each pair of slots is configured to receive the pair of rails 44D of a respective clip 44. The hook 44F of each clip is configured to be connected to the flange 28F of the frame section 28 at the right side of the board assembly 222A shown in FIGS. 17-19 in a similar manner to the manner that the clips 44 are connected to the lower frame sections to mount the accessory trays thereon in the embodiments of FIGS. 1A, 1B, 3A, and 8A-8C.

Figure 20:
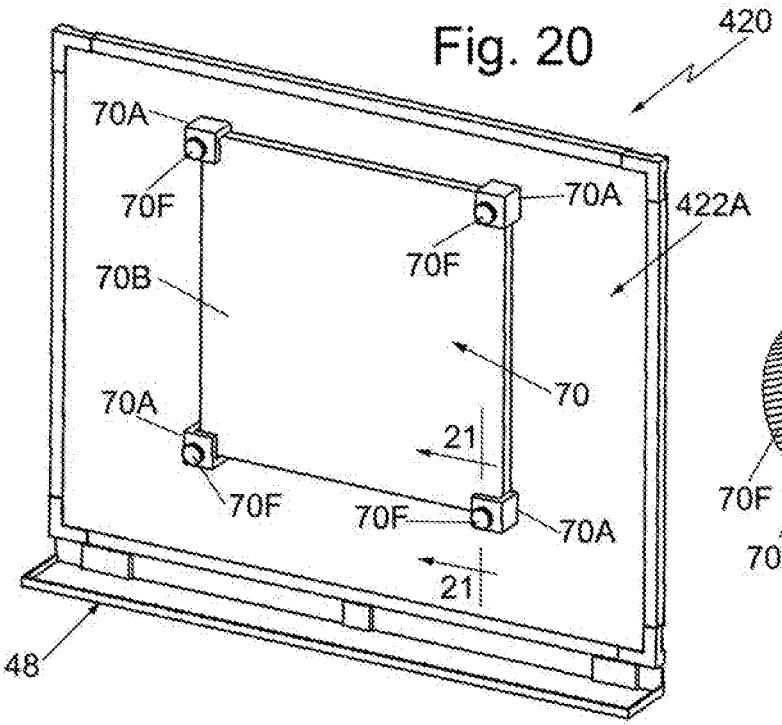
FIG. 20 is an isometric view of another exemplary embodiment of a wall organization system including a board assembly but making use of two accessories constructed in accordance with this invention, one of such accessories being the tray shown in FIG. 9A and the other being an accessory panel mounted on the board assembly by four magnetically attractive bracket members constructed in accordance with this invention.
Figure 22:
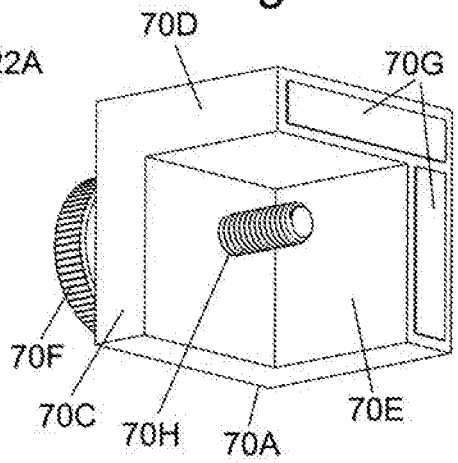
FIG. 22 is an enlarged isometric view taken from the rear of one of the magnetically attractive bracket members shown in FIG. 20.
Figure 21:
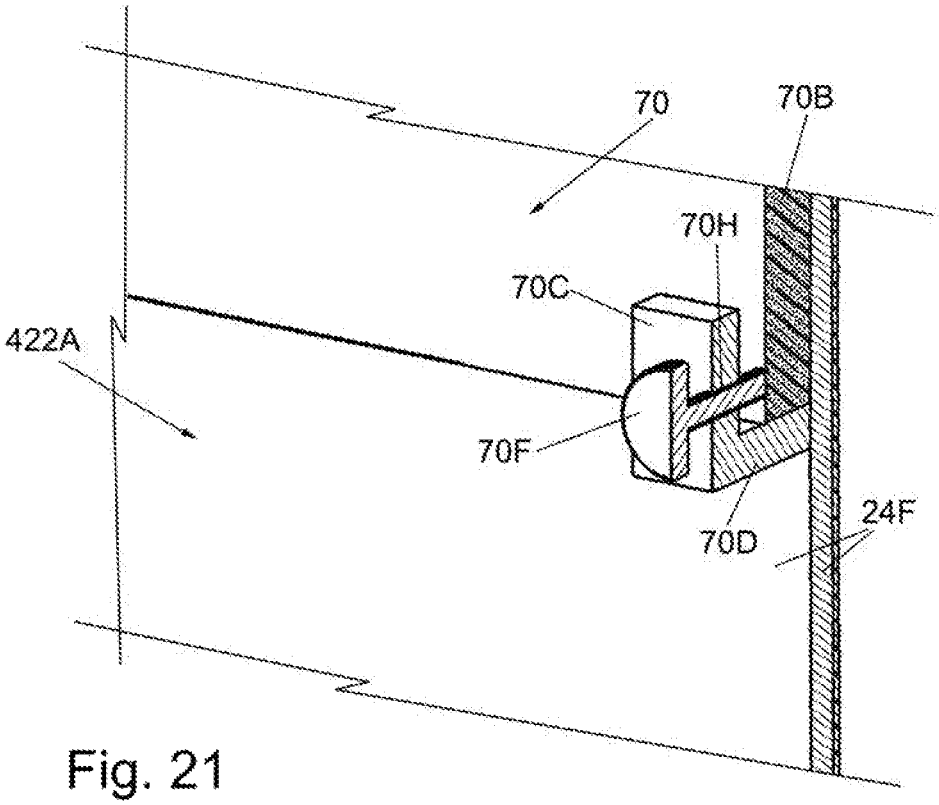
FIG. 21 is an enlarged sectional view taken along line 21-21 of FIG. 20.

FIGS. 20-22 show still another exemplary wall organizing system 420 constructed in accordance with this invention. The system 420 basically comprises the board assembly 422A with the tray 48 mounted thereon, and with an additional accessory in the form of a magnetically attachable insert panel assembly 70 mounted on the board assembly. The insert panel assembly basically comprises four magnetically securable brackets 70A and an insert panel 70B. The brackets serve to magnetically secure the insert panel assembly onto the front face of the board assembly 422A. The insert panel 70B is a generally planar member which can be formed of any suitable material, like those described heretofore, depending upon the usage to which the insert panel is to be put. In the exemplary embodiment the insert panel 70B is in the form of a cork board, but that is merely exemplary.

The board assembly 422A is similar in construction to the board assembly 222A described above, except that it doesn't include a panel assembly 24, like that described above. Instead the board assembly 422A is in the form of a single panel 24F, which is formed of a ferromagnetic material and which is mounted within a frame assembly 26 constructed like those described above, i.e., a plurality of frame sections 28 interconnected by a plurality of corner nodes 30. The ferromagnetic panel 24F may be painted or may be coated with some appropriate material, e.g., a dry-erasable material to form a dry erase board, or may be provided with some graphic image, e.g., a photograph, art work, etc., depending upon the application for which the panel assembly 70 is to be put and providing that the coating doesn't not materially lessen the magnetic attraction of the panel assembly 70 to the ferromagnetic panel 24F of the board assembly 422A.

As will be appreciated by those skilled in the art the insert panel assembly 70 can be thought to be of a frameless construction, unlike other insert panel assemblies constructed in accordance with this invention. In particular, the insert panel assembly 70 basically comprises four identical magnetically attachable brackets 70A and an insert panel 70B. FIG. 22 shows one of the identical brackets. Each bracket 70A includes a front wall 70C, a top wall 70D, a sidewall 70E and a screw 70F. The screw has an enlarged fluted head and an externally threaded shaft projecting under the head. The underside or free edge of the top wall 70D and the end wall 70E each include a magnetic strip 70G thereon. The head of the screw 70F is located outside the front wall 70C with the externally threaded shaft of the screw extending through an internally threaded hole 70H so that the free end of the screw's shaft is located within the confines of the bracket.

The four brackets 70A are configured to be disposed on the ferromagnetic panel 24A in an array so that each forms a respective corner of the insert panel assembly 70. To that end one bracket 70A is located at one corner of the insert panel 70B so that the screw's shaft is closely adjacent the outer surface of the corner of that panel. The magnetic strips on the undersurface of the bracket can then be brought into magnetic engagement with the ferromagnetic panel 24F to magnetically secure the bracket thereto. Another bracket can be placed on another corner of the insert panel and that bracket magnetically secured to the ferromagnetic panel 24F. That process can be repeated until all of the brackets are in place on the ferromagnetic panel. The screws 70F can then be tightened to cause their free ends to engage the front surface of the insert panel 70B to thereby releasably lock it place. If the insert panel assembly 70 is desired to be moved to a different position on the board assembly 422, that can be readily accomplished by sliding it across the front surface of the ferromagnetic panel 24F to the desired position without breaking the magnetic attraction therebetween.

Figure 23A:
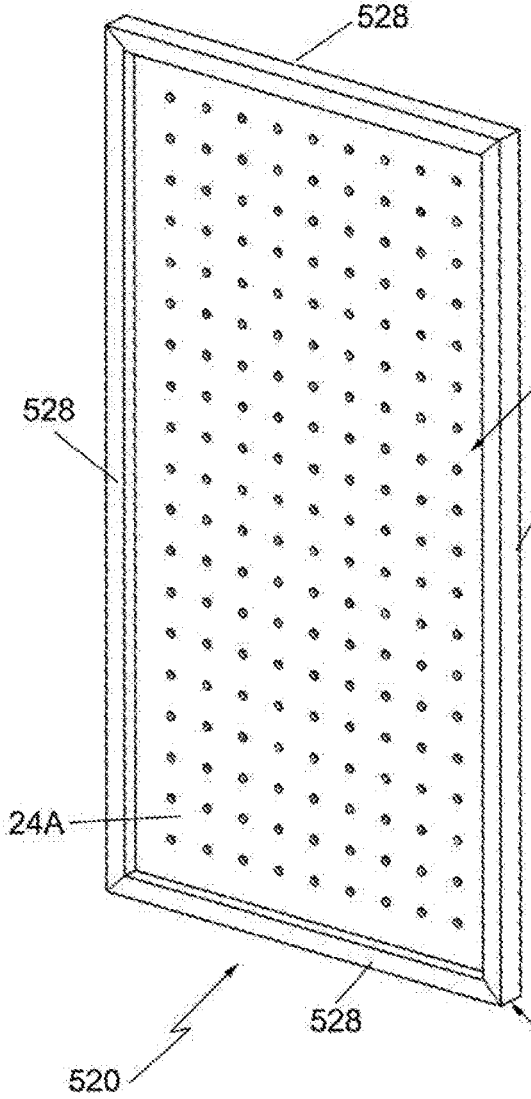
FIG. 23A is a front isometric view of another modular wall organization system including an alternative board assembly constructed in accordance with this invention and making use of different elongated frame sections and different corner node members from those of the frame assemblies of the prior figures.
Figure 23B:
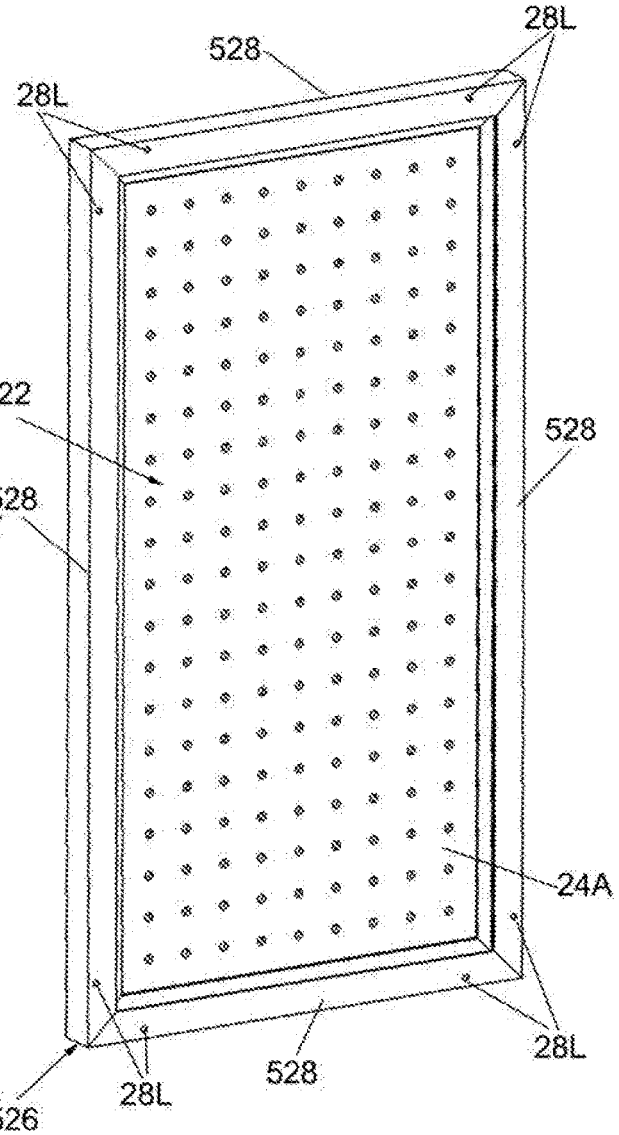
FIG. 23B is a rear isometric view of the modular wall organization system shown in FIG. 23A.
Figure 23C:
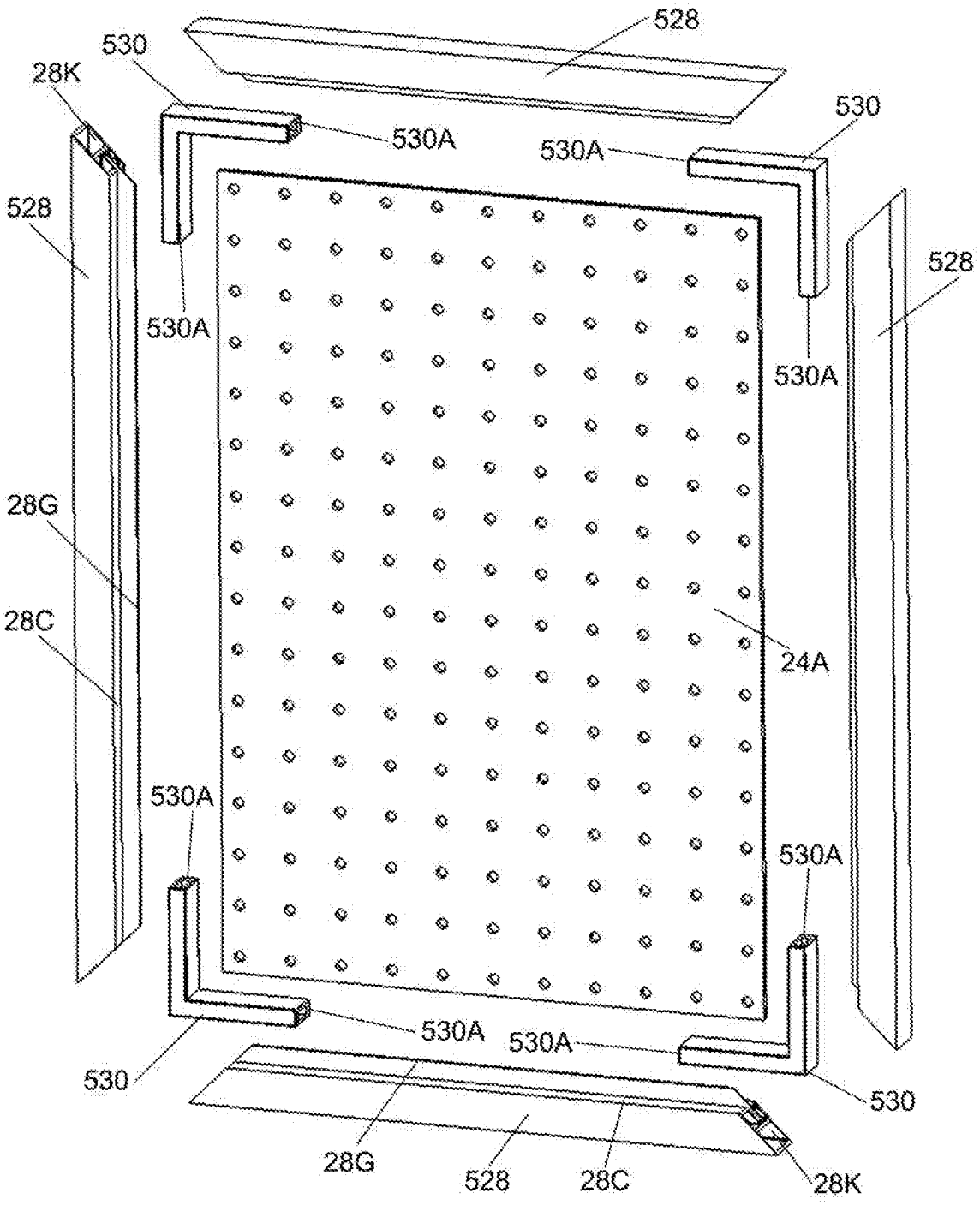
FIG. 23C is an exploded front isometric view of the modular wall organization system shown in FIGS. 23A and 23B.

FIG. 23A is a front isometric view of another wall organization system 520 constructed in accordance with this invention. That organization system includes a single board assembly 522. The assembly 522 basically comprises a peg-board panel 24A like that described above, and a frame assembly 526 surrounding and holding the peg-board panel. The frame assembly 526 is made up of a plurality, e.g., four, alternatively constructed frame sections 528, and a plurality of alternatively constructed corner nodes 530. Each of the alternate frame sections 528 is constructed identically to the frame sections 28 described heretofore, except that each end of each alternate frame section 528 is mitered, as shown clearly in FIGS. 23C and 23E. In the interest of brevity the common features of the frame sections 528 with the frame sections 28 will be given the same reference numbers and will not be described in detail. The alternate corner nodes 530 serve to connect adjacent frame sections 528 to form respective corners of the frame assembly 526. Each corner node 530 of the frame assembly is of identical construction and is best seen in FIG. 23. In particular each corner node 530 consists of two elongated leg sections 530A extending perpendicularly to each other. Each leg section is constructed similarly to the projecting portions 30G of the corner nodes 30. Thus, each leg section 530A is a hollow member that is of rectangular shape in cross section. Moreover, each leg section is configured to be tightly received within a respective passageway 28K of a respective frame section 528 to secure each frame section 528 to the corner node 530 and thus form a respective corner of the frame assembly 526. Thus, the four frame sections 528 of the frame assembly 526 are connected to one another by respective ones of the four corner nodes 530 to complete the frame assembly 526.

Figure 23D:
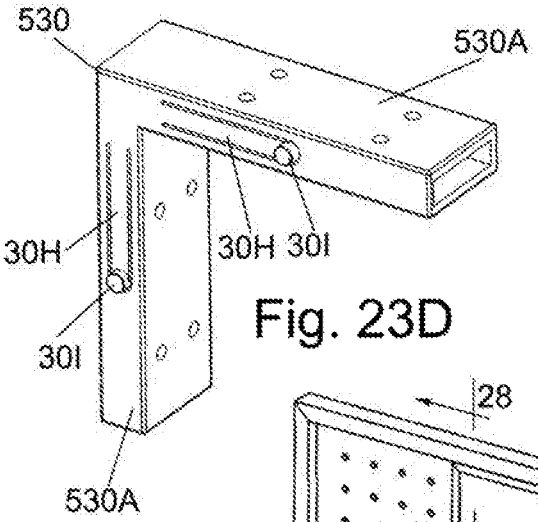
FIG. 23D is an enlarged rear isometric view of an alternative corner node member forming a portion of the frame assembly of FIGS. 23A-23C.
Figure 23E:
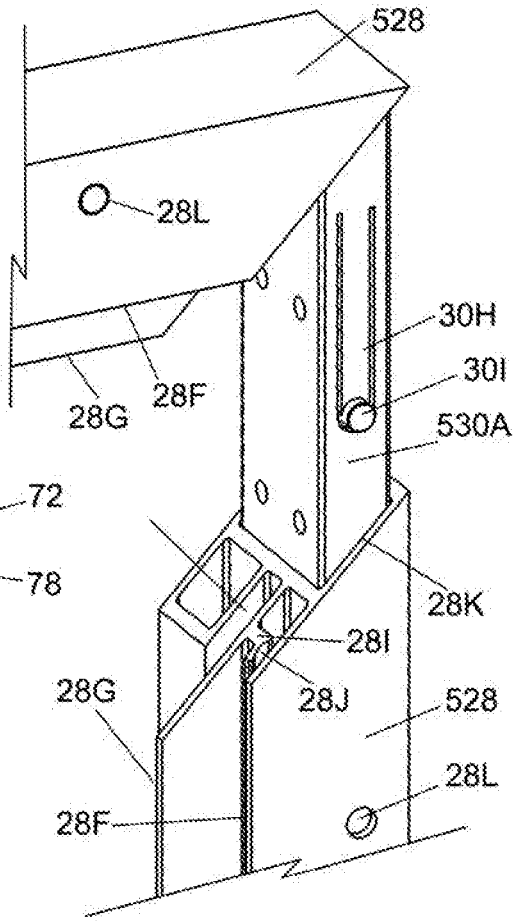
FIG. 23E is a more greatly enlarged rear front isometric view showing the alternative corner node member like that of FIG. 23D in the process of connecting two elongated frame sections to each other to form the frame assembly of the alternative board assembly shown in FIGS. 23A-23C.

As best seen in FIG. 23D the back surface of each leg section 530A includes the same detent mechanism as found in the projections 30G of each corner node 30 to effect the snap-fitting of the frame section 528 to the corner node 530. In particular, that detent mechanism is in the form of a spring finger 30H terminating in a thickened or bulbous end 301. Each finger 30H is configured to flex slightly inward into the hollow interior of the leg 530A as the leg is extended into the passageway 28K of the adjacent frame section 528 until the bulbous end 301 reaches the aperture or hole 28L, whereupon the finger flexes outward so that the bulbous end 301 snaps into the aperture or hole 28L, thereby snap-connecting the leg 530A to the frame section 528. The frame sections 528 can be disconnected from the corner nodes 530 in a similar manner as described above. To that end, pressing on the bulbous end 301 of the spring finger extending out of the aperture or hole 28L causes the spring finger to flex inward. This action frees the bulbous end 301 from the aperture or hole 28L, whereupon the leg section 530A can be withdrawn from the passageway 28K in the frame section 528 thereby separating the frame section from that corner node.

The peg-board panel 24A is mounted within the frame assembly 526 by a respective peripheral edge of the panel 24A being located within the gap 28H of a respective frame section 528. Since each frame section includes the flange 28F, that flange can be used to mount any of the accessories 42, 48, 50, 52 and 54 thereon by usage of hanger clips 44. Moreover, one board assembly 522 may be connected to a second board assembly 522, of either the same size of a different size, by use of one or more connector clips 34 like those described above. In such a case one of the rails 34D of the connector clip 34 can be snap connected over the free edge of the flange 28F of one of the board assemblies, while the other of the rails of the connector clip 34 can be snap connected over the free edge of the flange 28F of the other of the board assemblies.

Figure 24:
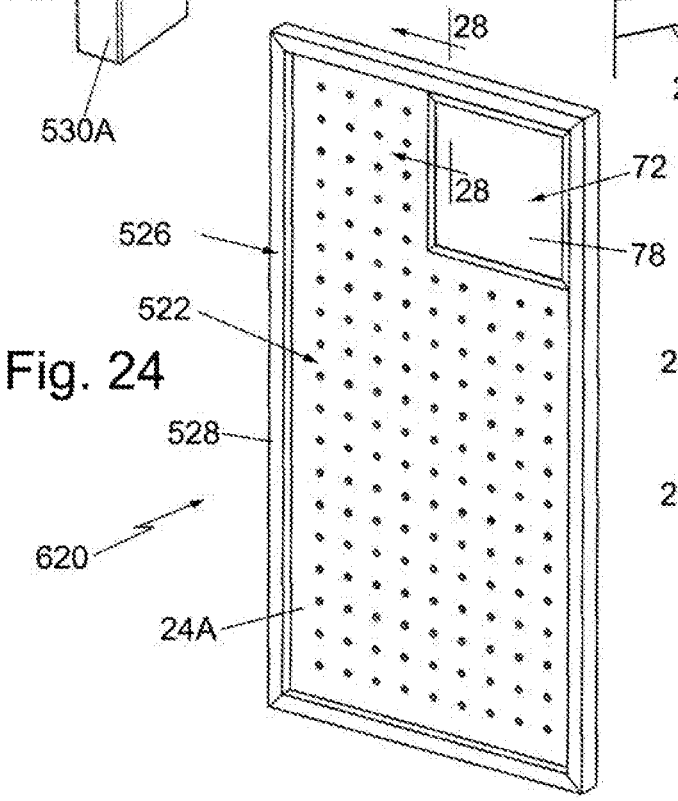
FIG. 24 is an isometric view similar to that of FIG. 23A and showing the board assembly of FIGS. 23A and 23B mounting an accessory in the form of an insert panel assembly thereon.

In FIG. 24 there is shown another wall organization system 620 constructed in accordance with this invention. The system 620 basically comprises a board assembly 522 like that shown in FIG. 23A and another accessory constructed in accordance with this invention. That other accessory is in the form of an insert panel assembly 72. The insert panel assembly is configured to be mounted onto the front surface of the board assembly at any location thereon to provide a face panel having a desired property, e.g., a cork-board, a dry-erase board, a chalk-board, a fabric-wrapped board, a slat-board, a letter-board, or any other material board. Moreover, the insert panel assembly can be sized and shaped so that multiple insert panel assemblies can be mounted on the board assembly 522.

The exemplary insert panel assembly 72 is best seen in FIGS. 25, 26, 28 and 28A and basically comprises a frame 74, a mounting base plate 76, a plurality (e.g., four) of the heretofore identified snap-connector pin 58, and a front plate 78. The front plate 78 forms the face panel of the insert panel assembly 72. The frame 74 comprises an L-shaped member in cross section and is formed of any suitable material, e.g., metal or plastic. The frame can be any size so that it can fit and be mounted within the confines of the frame assembly 526 of the board assembly 522. The exemplary frame assembly 72 shown in FIG. 24 makes use of a square shaped frame 74. The mounting base plate 76 is a planar member which is shaped to closely fit within the confines of the frame 74 and is formed of any suitable material, e.g., metal or plastic. The mounting base plate includes four holes 76A located adjacent respective corners thereof. Each hole 76A extends from the front surface of the mounting plate 76 to the rear surface thereof, and includes an enlarged annular recess extending on the front surface of the mounting plate 76 surrounding the hole. Each hole and its annular recess is configured to receive a respective snap-connector pin 58, with the head 58A of the pin located in the recess, and with the split shaft 58B extending through the hole so that the split shaft 58C with its bulbous ends 58C projects out the inner surface of the plate 76 like shown in FIG. 26. That action enables the insert panel assembly to be mounted on the peg-board panel 24A, as will be described shortly.

As mentioned above the front plate 78 forms the face panel of the insert panel assembly. That plate can be constructed of any particular desirable material for its intended purposes. For example, FIG. 29 shows six exemplary plates that can be used for the front plate 78. They are a cork-board 78A panel, a dry-erase board panel 78B, a chalk-board panel 78C, a fabric-board (e.g., a wrapped linen board) 78D, a slat-board panel 78E, and a letter-board panel 78F. Other front plates are contemplated, such as a galvanized metal board, a board bearing some graphics (e.g., photographs, drawings, artwork, etc.) thereon, a mirror, etc. The dry erase board may be formed of a ferromagnetic material with a dry erase coating thereon. The slat-board 78E can be of conventional construction having plural L-shaped slats 78E' extending across the front surface like shown in FIG. 29A. The slats 78E' can be used to hang items therefrom, either directly or by means of conventional hooks inserted into the slats. The letter-board 78E is can also be of conventional construction including horizontally located lined slots 78F' in the front surface like shown in FIG. 29B. Those lined slots are configured for receiving portions of letters to be mounted thereon. The front plate 78 is secured by any suitable means, e.g., epoxy, to the front surface of the mounting base plate 76 after the snap-connector pin 58 are inserted into the holes 76A and that unit can then be inserted into the L-shaped frame 74 to complete the insert panel assembly 72.

The insert panel assembly 72 is configured to be mounted onto the front surface of the peg-board panel 24A by juxtaposing it so that the portions of the snap-connector pins extending out of the rear of the insert panel assembly 74 can be inserted and snap-fit into respective aligned holes 24A' in the peg board 24A, as best seen in FIGS. 28 and 28A. That action releasably mounts the insert panel assembly 74 onto the board assembly 522.

If it is desired to remove the insert panel assembly 74 from the board assembly 522 that can be readily accomplished by merely pulling it away from the board assembly, whereupon the split shafts of the snap-connector pins will flex towards each other so that their bulbous free ends can pass through the peg-board holes 24A'.

It should be pointed out at this juncture that the insert panel assembly may include an intermediate panel disposed between the mounting base plate 76 and the face plate 78. That intermediate panel may be in the form of a corrugated cardboard or corrugated plastic panel like that of FIGS. 8A and 8B.

Figure 30:
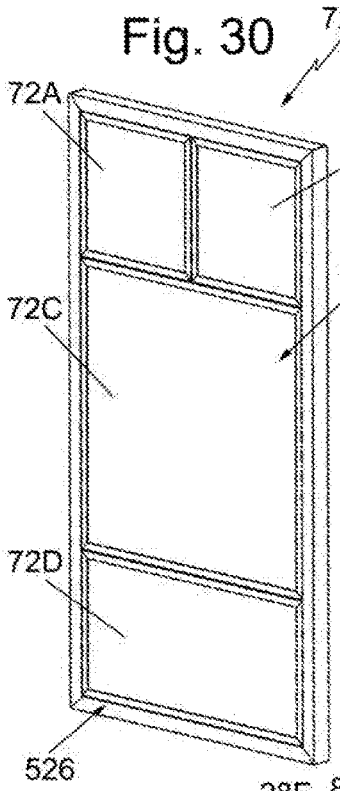
FIG. 30 is a front isometric view of another modular wall organization system like that of FIG. 24 but shown including four exemplary accessories in the form of two small size insert panel assemblies, one medium size insert panel assembly, and one enlarged insert panel assembly, each of those insert panel assemblies including a front panel which can be selected from any of the six types shown in FIG. 29.

FIG. 30 shows another wall organization system 720 constructed in accordance with this invention. The system 720 basically comprises a board assembly 522 like that shown in FIG. 24, but with four different insert panel assemblies 72A, 72B, 72C, and 72D. Each of those insert panel assemblies is constructed similarly to the insert panel assembly 72 in FIG. 24, except that their front panels 78 may take any of the forms as described heretofore. Moreover, the insert panel assemblies 78A and 78B are each of the same small size, e.g., 10 inches by 10 inches, whereas the insert panel 72C is of a medium size, e.g., 10 inches by 15 inches, and the insert panel 72D is of a large size, e.g., 15 inches by 20 inches. It should be pointed out at this juncture that the sizes of the insert panel assemblies shown and described with reference to FIG. 30 are merely exemplary.

Figure 31:
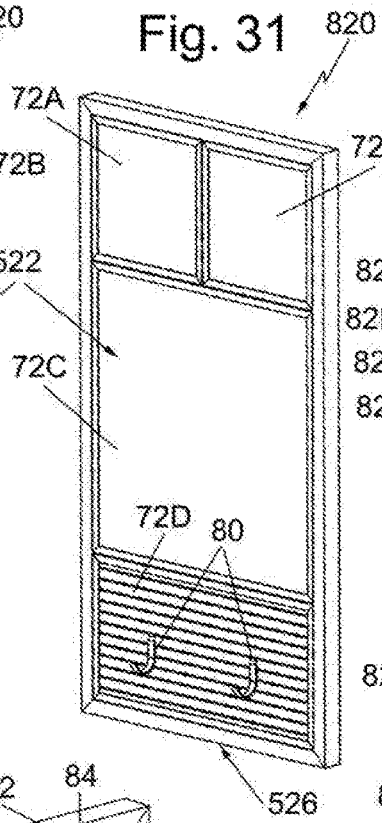
FIG. 31 is an isometric view, like that of FIG. 30, but showing the medium size insert panel assembly in the form of a slat-board supporting a pair of display hooks thereon.

FIG. 31 shows another wall organization system 820 constructed in accordance with this invention. The system 820 is identical to the system 720, except that the medium size insert panel 72D is shown in the form of a slat-board having a pair of hooks 80 mounted thereon.

Figure 33A:
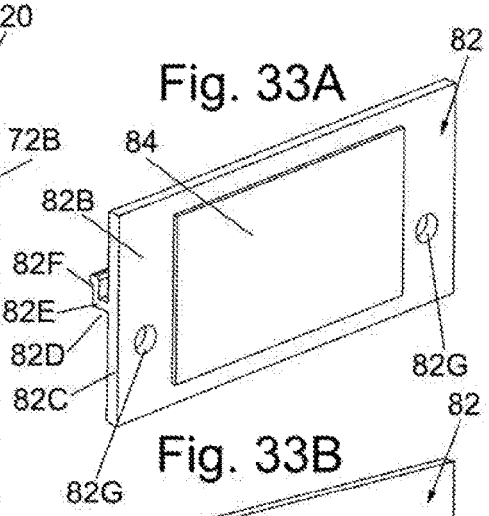
FIG. 33A is an enlarged rear isometric view of the clip or bracket shown in FIG. 32 with an adhesive pad mounted thereon.
Figure 33B:
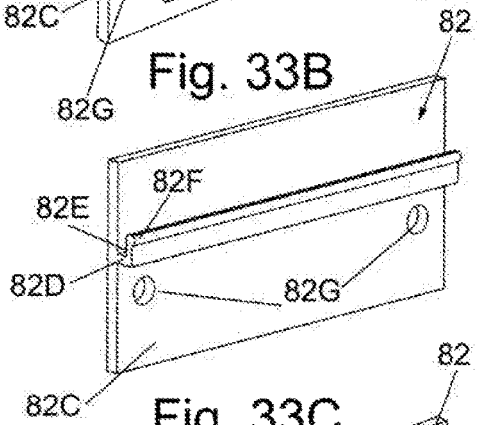
FIG. 33B is an enlarged front isometric view of the clip or bracket shown in FIG. 33A.
Figure 32:
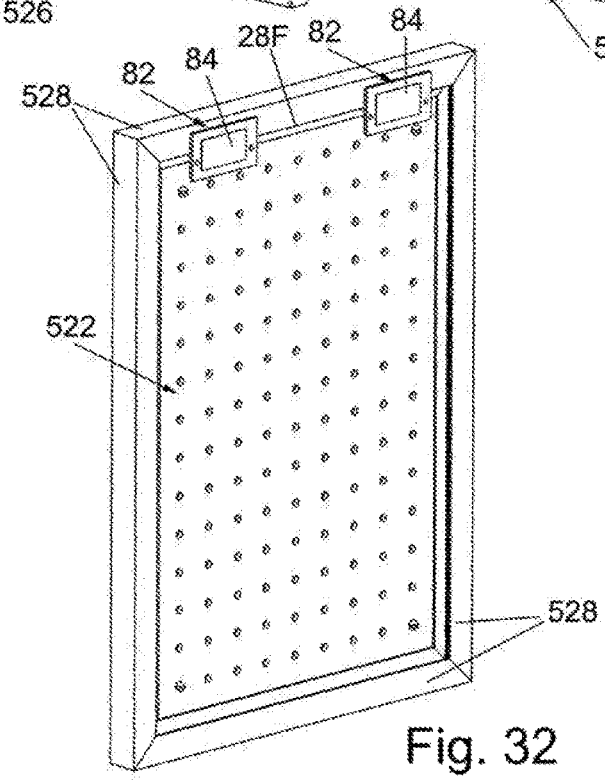
FIG. 32 is a rear isometric view of a wall organization system like that of FIGS. 23A and 24, but showing a pair of mounting clips or brackets with adhesive pads thereon for adhesively mounting the wall organization system on a wall of a structure.

FIG. 32 shows the rear surface of any of the board assemblies 522 described above but with means to mount it on a wall. That means basically comprises a pair of identical hanger hooks 82. Each of the hanger hooks is configured be mounted on the wall of a structure on which the board assembly is to be mounted to suspend the board assembly on that wall. FIGS. 33A and 33B show one of the hanger hooks 82. Thus, as can be seen each hanger connector hook is formed of any suitable rigid material, e.g., metal or plastic, and can be formed as an extrusion or by molding. The hanger hook basically comprises a thin, e.g., 1/16 inch, generally planar rectangular body 82A having planar rear surface 82B and a planar front surface 82C. The rear surface includes a horizontally extending wall-like projection 82D extending thereacross. The projection 82D includes an upwardly extending flange 82E having a bulbous elongated ridge 82F extending along the outer surface of the flange at its free end. A pair of holes 82G extend through the body 82A adjacent each side edge of the body. The flange 82E is configured to be extended under the flange 28F of the upper frame section 528 of the board assembly 522 so that the linear ridge 82F is snap fit between the inner surface of the flange 28F and the groove 28J in the horizontal flange 281 of that frame section to releasably secure the hanger hook 82 to the board assembly 522A.

Figure 34:
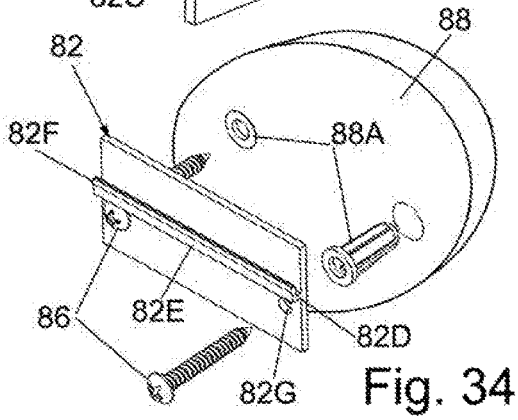
FIG. 34 is an exploded isometric view showing the mounting of the clip or bracket of FIGS. 33B and 33C on a wall, e.g., a sheet rock or wall-board panel, using screws in lieu of an adhesive pad.

The mounting of the hanger hook 82 on a wall or other surface of a structure can be accomplished by means of adhesive securement or by means of screws or other mechanical fasteners, e.g., nails, etc. In the embodiment shown in FIG. 32 each of the two hanger hooks is configured to be secured to a wall by means of a double-sided adhesive patches 84. In particular, as best seen in FIG. 33A the planar rear surface 82B of the hook 82 includes a double adhesive sided patch 84 secured thereto, so that the adhesive on the side of the patch facing away from the hanger hook can be secured to the wall or other surface of the structure. If adhesive securement isn't desired the hanger hook be mounted on the wall or other surface of the structure by means of a pair of screws 86 extended through respective holes 82G in the hanger hook like shown in FIG. 34. In that figure a portion of the wall 88 of the structure includes two conventional wall anchors 88A for receipt of respective threaded shanks of the screws 86 extending through the holes 82G of the hanger hook 82.

Figure 33C:
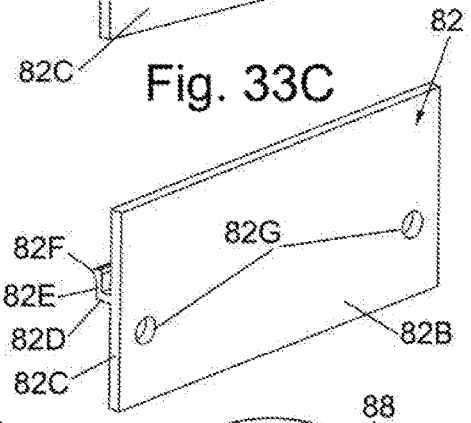
FIG. 33C is an enlarged front isometric view of the clip or bracket shown in FIG. 33A without the adhesive pad mounted thereon.

FIG. 35 shows another wall organization system 920 constructed in accordance with this invention. The system 920 comprises a board assembly 922 composed of a frame 926 and a peg-board panel 24A mounted therein. The frame 926 is composed of four frame sections 928 each of which is somewhat similar in construction to the frame sections 528 but are of solid construction, e.g., formed of wood, without any passageway extending therethrough. The mitered ends of the frame sections 928 are directly connected together at each corner without use of any corner node. Instead they are connected together by an adhesive or some other fastening means, e.g., staples, nails, screws, etc. (not shown). Each frame section 928 includes some features like the frame sections 528. In particular, each frame section 928 includes a front face 928A, a rear face 928B, a top face 928C, a bottom face 928D. A short height, planar flange 928F projects vertically upward flush with the rear face. A similar height planar vertical flange 928G projects upward between the front and rear faces and separated from the top face 928C by a gap 928H. The flange 928G and its gap 928H serves to receive a peripheral portion of the peg-board 24A like shown in FIGS. 37A and 37B to mount the peg-board within the frame. The flange 928F of each frame section serves the same function as the flange 28F of each of the heretofore discussed frame sections 528. Thus, the flange 928F can be used to connect one board assembly 922 to another board assembly having a similar frame using a connector clip 34 in a similar manner as described above with reference to the system 120. The flange 928F can also be used by one or more hanger connector clips 44 to mount any of the accessories shown in FIGS. 1A and 9A-9D thereon or to mount the board assembly 922 onto a wall 88 of a structure using the hanger hooks 82 shown in FIGS. 33A-34

The frame 926 itself can be used with hanger hooks 60 for hanging the accessory panel insert 56 like that of FIG. 10A on the board assembly 922 or can be used with the hanger hooks 66 for hanging the accessory roll 62 of writing material on the board assembly 922. Furthermore, since the board assembly 922 includes the peg-board 24A, it can be used to mount any insert panel assembly 72 on the peg-board like shown in FIGS. 24,30 and 31.

It should be pointed out at this juncture that the systems and components thereof and the accessories for such systems as described above are modular, and can be used in a multitude of configurations. Thus, the specific examples given are merely exemplary and many others are contemplated within the scope of this invention, whereupon the exemplary systems, components and accessories as described above should not be deemed limiting. For example, while the accessories as specifically described above are trays, baskets, support rods, cubby hole units, it should be noted that those are merely examples and other accessories which are decorative and/or functional are contemplated within the scope of this invention. Moreover, the cork boards, dry erase boards, chalk boards, fabric-wrapped boards, decorative boards, letter boards, magnetic boards, and mirrors specifically described above are also merely some examples of various boards that can form a portion of the systems of this invention. Thus, the systems of the subject invention may make use of any type of board that a user contemplates fitting within the wall organization system. Further still, the examples of the materials making up the frames, e.g., plastic, aluminum, wood, are also merely specific examples of various materials that can be used. Thus, it is contemplated that other materials, such as steel, carbon fiber, fiberglass, composite materials, hard rubber, etc. can be used. In fact, the same can be said for the corner nodes, snaps connectors, hanger clips, spacer disc, peg-boards, etc. the systems of this invention, i.e., they can also be made from other materials as well.

Without further elaboration the foregoing will so fully illustrate our invention that others may, by applying current or future knowledge, adopt the same for use under various conditions of service.

We claim:

1. A modular wall organization system configured to be mounted on a wall of a structure, the modular wall organization system comprising a first board assembly, said first board assembly comprising:

a first planar panel having plural corners; and a first frame assembly comprising plural elongated first frame sections, plural first corner nodes, and plural detent mechanisms, said corner nodes and said elongated first frame sections being configured to be releasably connected and disconnected from one another, each of said plural first corner nodes including two projections, each of said projections including one portion of a respective one of said plural detent mechanisms, each of said elongated first frame sections having a front face, a rear face, an inner face, an outer face, and an opposed pair of hollow ends, each of said hollow ends including a second portion of a respective one of said plural detent mechanisms, said hollow ends being configured to receive and snap-fit a respective one of said two projections of a respective first corner node whereby said detent mechanisms releasably connect said plural first elongated frame sections to one another to surround and hold said first planar panel, said first frame assembly having a front face, a rear face, an inner face and an outer face formed by said front faces, said rear faces, said inner faces, and said outer faces, respectively, of said elongated first frame sections, at least one of said elongated first frame sections including a first projecting flange extending flush with or closely adjacent and parallel to said rear face and a second projecting flange having a planar free end portion extending in a plane parallel to said first projecting flange, said second projecting flange being located between said first projecting flange and said front face, said second projecting flange forming a portion of a gap configured to receive a portion of said first planar panel, said first projecting flange having an exposed free edge facing toward said inner face and away from said outer face, said exposed free edge being configured to mount at least one clip or at least one hanger on said exposed free edge wherein further including a third projecting flange extending from said second projecting flange towards said first projecting flange; wherein said third projecting flange and said first projecting flange cooperate to support said at least one clip or said at least one hanger.

2. The modular wall organization system of claim 1, additionally comprising a second board assembly, said second board assembly comprising a second planar panel having plural corners and a second frame assembly, said second frame assembly comprising plural elongated second frame sections, and plural second corner nodes, each of said second plural corner node members of said second frame assembly including two projections, each of said second elongated frame sections of said second frame assembly having a front face, a rear face, an inner face, an outer face, and an opposed pair of hollow ends, each of said hollow ends being configured to receive and snap-fit a respective one of said two projections of a respective second corner node for connecting said plural elongated second frame sections together to surround and hold said second planar panel, at least one of said first corner nodes of said first frame assembly being configured to be releasably connected to at least one of said second corner node of said second frame assembly by a releasably securable snap-connector.

3. The modular wall organization system of claim 2, wherein said first corner nodes comprises a body having a back surface, a first side edge, a second side edge, a first channel, and a second channel, said first side edge of said first corner node extending at a predetermined angle to said second side edge of said first corner node, said first channel of said first corner node member extending into said body of said first corner node member from said first side edge of said first corner node member, said second channel extending into said body of said first corner node member from said second side edge of said first corner node member, wherein said second corner node comprises a body having a back surface, a first side edge, a second side edge, a first channel, and a second channel, said first side edge of said second corner node extending at a predetermined angle to said second side edge of said second corner node, said first channel of said second corner node extending into said body of said second corner node from said first side edge of said second corner node, said second channel of said second corner node extending into said body of said second corner node from said second side edge of said second corner node, and wherein said releasably securable snap-connector has a first extending portion and a second extending portion, said first extending portion being configured to snap-fit into one of said first and second channels of said first corner node, said second extending portion being configured to snap-fit into one of said first and second channels of said second corner node to secure said first corner node to said second corner node.

4. The modular wall organization system of claim 1, additionally comprising an accessory and at least one clip, said accessory being configured for mounting on said first board assembly by said at least one clip, said accessory comprising a wall including a least one slot therein, said clip having a portion configured to snap-fit within said at least one slot to secure said clip to said wall, said clip including a portion being configured for mounting on said first projecting flange of said first elongated frame section of said first frame assembly.

5. The modular wall organization system of claim 4, wherein said accessory is selected from a group consisting of a tray, a basket, a support rod, and a cubby-hole unit.

6. The modular wall organization system of claim 1, wherein one of said elongated first frame sections of said first frame assembly is an upper frame member and wherein said modular wall organization system additionally comprises an accessory and at least one hanger, said accessory being configured for mounting on said first board assembly by said at least one hanger engaging said upper frame member.

7. The modular wall organization system of claim 6, wherein said accessory comprises a roll of writing material having a central opening and a cylindrical rod extending through said central opening, said at least one hanger includes an upper hook portion configured to extend over and engage said upper frame member, and a lower section including a curved socket configured for supporting an end of said central cylindrical rod.

8. The modular wall organization system of claim 1, wherein one of said first elongated frame members of said first frame assembly is an upper frame member and wherein said modular wall organization system additionally comprises an accessory and at least one hanger having an upper hook portion, said accessory being configured for mounting on said first board assembly by said upper hook portion of said at least one hanger engaging said upper frame member, said accessory comprising an insert panel assembly comprising a planar panel and a frame surrounding said planar panel, said frame including an upper elongated frame section having a rear face and a downwardly projecting flange extending flush with or closely adjacent and parallel to said rear face, said at least one hanger including a flanged portion configured to receive said downwardly projecting flange.

9. The modular wall organization system of claim 8, wherein said planar panel is selected from the group consisting of a cork board, a dry-erase board, a chalk board, a fabric wrapped board, a slat board, and a letter board.

10. The modular wall organization system of claim 9, wherein said frame of said insert panel assembly is constructed similarly to said first frame assembly.

11. The modular wall organization system of claim 1, wherein said first planar panel comprises peripheral edge portions and wherein each of said first elongated frame sections of said first frame assembly additionally comprise a gap adjacent said inner face thereof, each of said gaps being configured to receive a respective peripheral edge portion of said first planar panel.

12. The modular wall organization system of claim 1, wherein said first planar panel is a peg-board having plural holes therein configured for receipt of at least one snap-connector pin to mount an item thereon.

13. The modular wall organization system of claim 12, wherein said item comprises a frame holding a rear panel and a front panel, said rear panel including at least snap-connector pin projecting outward from said rear panel for releasable securement with one of said plural holes in said peg-board.

14. The modular wall organization system of claim 13, wherein said front panel is a planar panel selected from the group consisting of a cork board, a dry-erase board, a chalk-board, a fabric-wrapped board, a slat-board, and a letter-board.

15. The modular wall organization system of claim 1, wherein said first planar panel is formed of a ferromagnetic material and wherein said system additionally comprises an accessory, said accessory comprising a planar accessory panel having corners and plural magnetically securable brackets, each of said magnetically securable brackets comprising a threaded clamping member, a pair of sidewalls merging together at a corner, and a front wall connected to said sidewalls, said front wall having an internally threaded hole extending through it, each of said sidewalls having an undersurface, at least one of said undersurfaces being magnetic and configured to be magnetically secured to said ferromagnetic material panel, said threaded clamping member having a cap from which an externally threaded shaft projects, said externally threaded shaft extending through said internally threaded hole in said front wall and having an end configured for engaging a surface of said planar accessory panel to releasably secure said planar accessory panel on said planar ferromagnetic panel.

16. The modular wall organization system of claim 15, wherein said planar accessory panel is selected from the group consisting of a cork board, a dry-erase board, a chalk board, a fabric wrapped board, a slat board, and a letter board.

17. The modular wall organization system of claim 1, wherein each of said rear face of each of said elongated first frame sections at said hollow end thereof includes a hole, and wherein each of said first corner nodes includes a detent mechanism in the form of a spring finger terminating and a thickened or bulbous end, said bulbous end being configured for receipt in a respective one of said holes to effect the snap-connection between said first corner nodes and said first elongated frame sections.

18. The modular wall organization system of claim 1 additionally comprising:

a second board assembly; and a clip comprising a first flanged edge and a second flanged edge, said second flanged edge being configured to be coupled to said second board assembly, said first flanged edge of said clip being configured to be coupled to said exposed free edge of said first projecting flange to connect said second board assembly to said first board assembly.

19. The modular wall organization system of claim 18, wherein said second board assembly comprises:

a second planar panel having plural corners; and a second frame assembly comprising plural second elongated frame sections, and plural second corner node members, each of said plural second corner node members including a pair of projections, said plural second corner node members being configured for connecting said plural second elongated frame sections to one another to form a second frame surrounding said second planar panel, each of said plural second elongated frame sections having an opposed pair of hollow ends configured to receive a respective projection of said pair of projections of a respective one of said plural second corner node members.

* * * * *